US009541867B2

(12) United States Patent
Ehara et al.

(10) Patent No.: US 9,541,867 B2
(45) Date of Patent: Jan. 10, 2017

(54) APPARATUS, METHOD, AND NON-TRANSITORY RECORDING MEDIUM FOR POWER GENERATION USING HEAT IN IMAGE FORMING APPARATUS

(71) Applicants: Homare Ehara, Kanagawa (JP); Takaaki Shirai, Tokyo (JP); Norikazu Okada, Kanagawa (JP); Tomoyuki Yamashita, Kanagawa (JP); Ryohta Kubokawa, Kanagawa (JP); Takuma Kasai, Kanagawa (JP); Keita Maejima, Kanagawa (JP)

(72) Inventors: Homare Ehara, Kanagawa (JP); Takaaki Shirai, Tokyo (JP); Norikazu Okada, Kanagawa (JP); Tomoyuki Yamashita, Kanagawa (JP); Ryohta Kubokawa, Kanagawa (JP); Takuma Kasai, Kanagawa (JP); Keita Maejima, Kanagawa (JP)

(73) Assignee: Rioch Company, Ltd., Tokyo (JP)

( * ) Notice: Subject to any disclaimer, the term of this patent is extended or adjusted under 35 U.S.C. 154(b) by 0 days.

(21) Appl. No.: 14/840,765

(22) Filed: Aug. 31, 2015

(65) Prior Publication Data

US 2016/0077475 A1 Mar. 17, 2016

(30) Foreign Application Priority Data

Sep. 16, 2014 (JP) ..... 2014-187696

(51) Int. Cl.
*G03G 15/20* (2006.01)
*G03G 15/00* (2006.01)

(52) U.S. Cl.
CPC ..... *G03G 15/2039* (2013.01); *G03G 15/2017* (2013.01); *G03G 15/80* (2013.01)

(58) Field of Classification Search
CPC ..... G03G 21/1857; G03G 15/2039; G03G 15/2017
USPC ..... 399/328, 69, 88
See application file for complete search history.

(56) References Cited

U.S. PATENT DOCUMENTS 8,432,064 B2 * 4/2013 Maeda ..... H02J 7/34 307/44

FOREIGN PATENT DOCUMENTS

CN 201654576 U * 11/2010
JP 2008040235 A * 2/2008
JP 2011-059273 3/2011

OTHER PUBLICATIONS

Computer translation of JP2011-059273A, Apr. 2011 to Yamaguchi; cited by applicant computer translation of JP2008-040235A, Feb. 2008 to Kudo.*
U.S. Appl. No. 14/745,828, filed Jun. 22, 2015.

* cited by examiner

*Primary Examiner* — Quana M Grainger
(74) *Attorney, Agent, or Firm* — Harness, Dickey & Pierce, P.L.C.

(57) ABSTRACT

An image forming apparatus includes a fixing device to fix an image on a recording medium by heating the recording medium, multiple heat storing devices to store heat generated at the fixing device, an electric generating element to generate power by converting the heat into power, and a switch to switch connection and disconnection between the electric generating element and at least one of the multiple heat storing devices.

11 Claims, 21 Drawing Sheets

FIG. 24

| TRANSFER PAPER SIZE | TRANSFER PAPER ORIENTATION | RUN LENGTH | TEMPERATURE DISTRIBUTION OF FIXING ROLLER |
|---|---|---|---|
| B5 | PORTRAIT | 1-10 | PROFILE X10 |
| | | 11-20 | PROFILE X20 |
| | | ... | ... |
| | | 91-100 | PROFILE X100 |
| | | ... | ... |
| | LANDSCAPE | 1-10 | PROFILE Y10 |
| | | 11-20 | PROFILE Y20 |
| | | ... | ... |
| | | 91-100 | PROFILE Y100 |
| | | ... | ... |
| ⋮ | ⋮ | ⋮ | ⋮ |

FIG. 26

| TRANSFER PAPER SIZE | TRANSFER PAPER ORIENTATION | RUN LENGTH | TONER AMOUNT | TEMPERATURE DISTRIBUTION OF FIXING ROLLER |
|---|---|---|---|---|
| B5 | PORTRAIT | 1-10 | 0%-10% | PROFILE Xc1-1 |
| | | | 10%-20% | PROFILE Xc1-2 |
| | | | ... | ... |
| | | 11-20 | 0%-10% | PROFILE Xc2-1 |
| | | | 10%-20% | PROFILE Yc2-2 |
| | | | ... | ... |
| | | ⋮ | ⋮ | ⋮ |
| | ⋮ | ⋮ | ⋮ | ⋮ |
| ⋮ | ⋮ | ⋮ | ⋮ | ⋮ |

FIG. 27

| TRANSFER PAPER SIZE | TRANSFER PAPER ORIENTATION | RUN LENGTH | ELAPSED TIME (MINUTE) | TEMPERATURE DISTRIBUTION OF FIXING ROLLER |
|---|---|---|---|---|
| B5 | PORTRAIT | 1-10 | 0-1 | PROFILE Xt1-1 |
| | | | 1-2 | PROFILE Xt1-2 |
| | | | ... | ... |
| | | 11-20 | 0-1 | PROFILE Xt2-1 |
| | | | 1-2 | PROFILE Yt2-2 |
| | | | ... | ... |
| | | ⋮ | ⋮ | ⋮ |
| | ⋮ | ⋮ | ⋮ | ⋮ |
| ⋮ | ⋮ | ⋮ | ⋮ | ⋮ |

FIG. 28

| TRANSFER PAPER SIZE | TRANSFER PAPER ORIENTATION | RUN LENGTH | HEATER USAGE STATE | TEMPERATURE DISTRIBUTION OF FIXING ROLLER |
|---|---|---|---|---|
| B5 | PORTRAIT | 1-10 | STATE A | PROFILE Xh1-1 |
| | | | STATE B | PROFILE Xh1-2 |
| | | | ... | ... |
| | | 11-20 | STATE A | PROFILE Xh2-1 |
| | | | STATE B | PROFILE Yh2-2 |
| | | | ... | ... |
| | | ⋮ | ⋮ | ⋮ |
| | ⋮ | ⋮ | ⋮ | ⋮ |
| ⋮ | ⋮ | ⋮ | ⋮ | ⋮ |

APPARATUS, METHOD, AND NON-TRANSITORY RECORDING MEDIUM FOR POWER GENERATION USING HEAT IN IMAGE FORMING APPARATUS

CROSS-REFERENCE TO RELATED APPLICATIONS

This patent application is based on and claims priority pursuant to 35 U.S.C. §119(a) to Japanese Patent Application No. 2014-187696, filed on Sep. 16, 2014 in the Japan Patent Office, the entire disclosure of which is hereby incorporated by reference herein.

BACKGROUND

Technical Field

The present invention relates to an image forming apparatus, an image forming method, and a non-transitory recording medium.

Description of the Related Art

There is a group of technologies to generate power in an image forming apparatus using extra heat generated in the fixing device therein to fix a toner image, etc. on a recording medium, typically paper.

SUMMARY

According to the present invention, provided is an improved image forming apparatus which includes a fixing device to fix an image on a recording medium by heating the recording medium, multiple heat storing devices to store heat generated at the fixing device, an electric generating element to generate power by converting the heat into power, and a switch to switch connection and disconnection between the electric generating element and at least one of the multiple heat storing devices.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 9 is a diagram illustrating an example of the heat supplying status to a power generating element when a second heat storing plate is separated from the power generating element while the image forming apparatus stands by;

FIG. 24 is a table illustrating a storing state of the temperature distribution profiles in the image forming apparatus illustrated in FIG. 1;

FIG. 26 is a table illustrating a storing state of the temperature distribution profiles in a variation example, corresponding to the table illustrated in FIG. 24;

FIG. 27 is a table illustrating a storing state of the temperature distribution profiles in another variation example, corresponding to the table illustrated in FIG. 24; and FIG. 28 is a table illustrating a storing state of the temperature distribution profiles in yet another variation example, corresponding to the table illustrated in FIG. 24.

Figure 1:
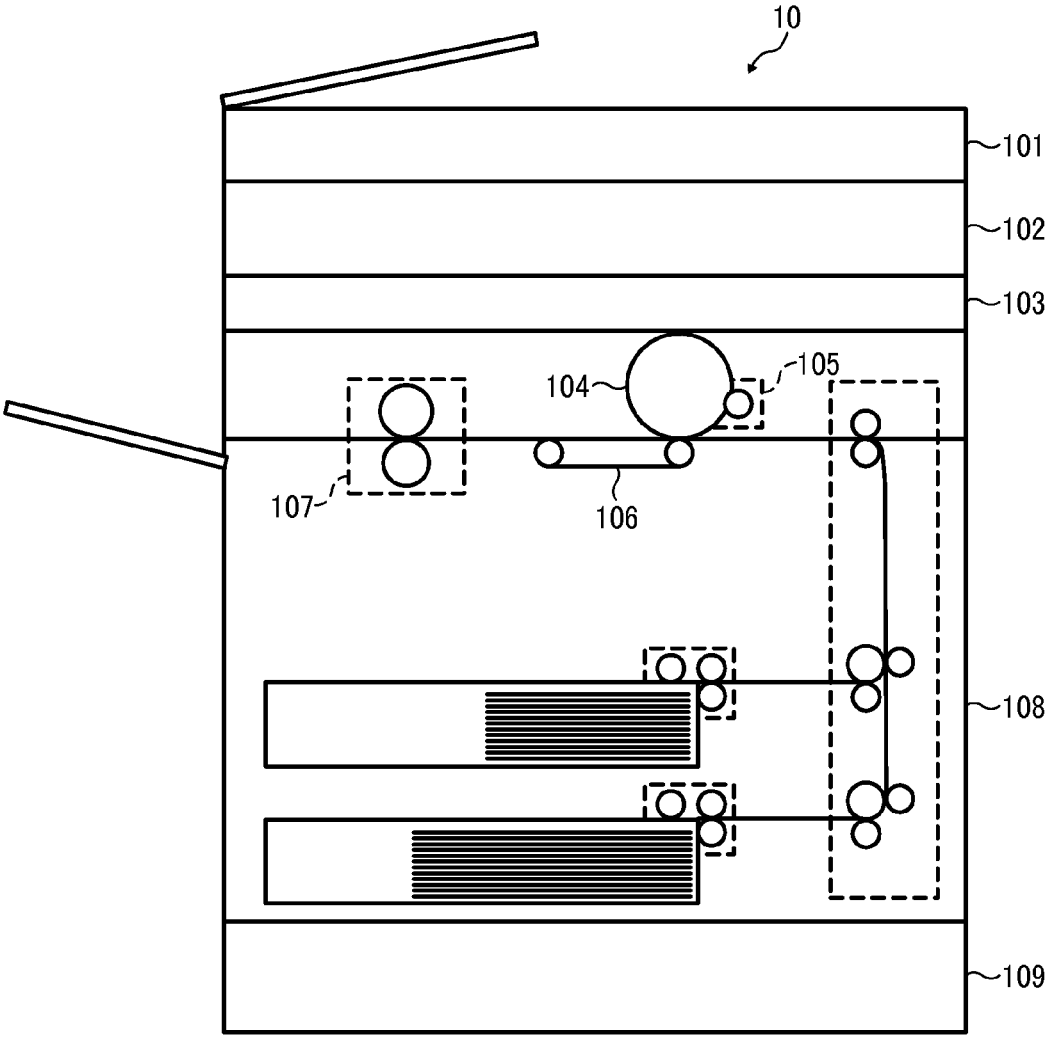
FIG. 1 is a cross section illustrating a schematic configuration of an image forming apparatus according to an embodiment of the present disclosure.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits, field programmable gate arrays (FPGAs) computers or the like. These terms in general may be referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

According to the present disclosure, power can be generated with a high level of efficiency even when the temperature of a fixing device is uneven.

Next, embodiments of the present disclosure are described with reference to accompanying drawings.

FIG. 1 is a cross section illustrating a schematic configuration of an image forming apparatus according to an embodiment of the present disclosure.

An image forming apparatus 10 illustrated in FIG. 1 is a digital multifunction peripheral (MFP) having various image processing features such as photocopying features, printing features, and facsimile features. In addition, an application switching key on the operation unit, the photocopying features, the printing features, and the facsimile features are sequentially switchable. The image forming apparatus 10 conducts processing based on the mode selected.

Incidentally, the image forming apparatus 10 can have one or more of these features.

With regard to the features of the image forming apparatus 10, operations on photocopying mode are described in detail.

In the photocopying mode, by an automatic document feeder 101, documents are sequentially fed to an image reader 102, where image information is read. The image information is converted into optical information by a writing unit 103 serving as a writing device via an image processing device. A drum image bearer 104 is uniformly charged by a charger and thereafter irradiated (exposed) according to the optical information from the writing unit 103 to form a latent electrostatic image thereon. The latent electrostatic image formed on the drum image bearer 104 is developed by the developing device 105 to form a toner image.

The toner image is transferred to transfer paper by a transfer belt 106. The toner image is fixed on the transfer paper by a fixing device 107 and transfer paper is ejected. As a consequence, images are printed on transfer paper serving as a recording medium by electrophotography.

A printer unit 108 is to transfer the same image as an original read according to optical information converted at the writing unit 103 to a recording medium and includes the drum image bearer 104, the developing device 105, the transfer belt 106, and the fixing device 107.

A capacitor unit 108 includes a condenser (storage battery 118) serving as a storing device) and stores electricity obtained by electric generation by the thermoelectric converter to supply the stored electricity to each unit. The condenser stores charges as electricity by application of a voltage. The condenser is just an example. Other storage devices such as a storage battery to store electricity utilizing chemical reaction can be also used.

Figure 2:
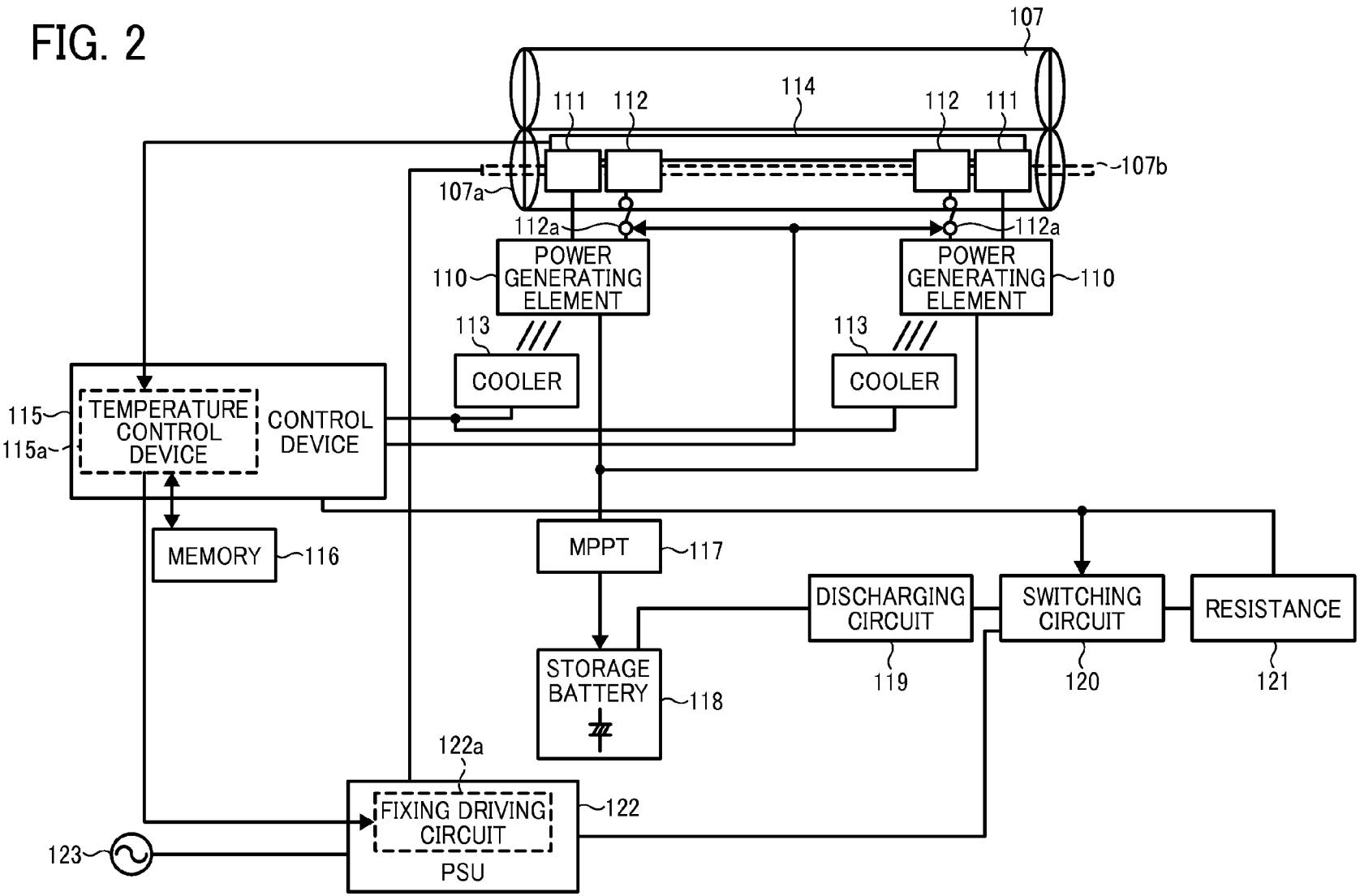
FIG. 2 is a block diagram illustrating the configuration of the image forming apparatus illustrated in FIG. 1 based on the fixing device and the power system therein.

Next, FIG. 2 is a diagram illustrating the fixing device 107, which is provided to the image forming apparatus 10, other devices adjacent thereto, and the power system connected to those devices.

As illustrated in FIG. 2, the image forming apparatus 10 has the fixing device 107, a fixing roller 107*a*, power generating elements 110, first heat storing plates 111, second heat storing plates 112, switches 112*a*, coolers 113, a temperature detecting element 114, a control device 115, a temperature control device 115*a*, a memory 116, a DC/AC converter 117 having a maximum power point tracking (MPPT) feature, a storage battery 118, a discharging circuit 119, a switching circuit 120, a load 121, a power supply unit (PSU) 122, and a fixing drive circuit 122*a*. PSU 122 is connected to a commercial power source 123.

Of these, the fixing device 107 fixes an image on a recording medium upon application of heat and pressure thereto by the fixing roller 107*a* having a heater 107*b*. The heater 107*b* heats the fixing roller 107*a*.

The power generating elements 110 generate power by a thermoelectric conversion element that converts heat energy to electric energy and provided to close to each end of the fixing roller 107*a*. The thermoelectric conversion element can be arbitrary thermoelectric conversion element, for example, typically used thermoelectric conversion element utilizing Seebeck effect.

In addition, heat storing members are provided at both ends of the fixing roller 107*a* to store the heat of the surface of the fixing roller 107*a*. The heat storing member is provided to efficiently transfer heat to the power generating elements 110 and composed of materials having large heat conductivity. The materials are not particularly limited. Metal materials such as aluminum or copper or a heat pipe are preferable. In the present disclosure, a pair of the first heat storing plates 111 and a pair of the second heat storing plates 112 are provided as an example of the heat storing members. At each end, the first heat storing plates 111 are arranged at the outer side and, the second heat storing plates 112, at the inner side.

Each of the first heat storing plates 111 and the second heat storing plates 112 is connected to the HOT surface of the power generating element 110 to store heat of the fixing roller 107*a* and supply it to the HOT surface. In addition, the switch 112*a* is provided between the second heat storing plate 112 and the power generating element 110 to switch connection and disconnection therebetween. The switch 112*a* switches between the high heat transfer efficiency state (connected) and the low heat transfer efficiency state (disconnected).

Moreover, the cooler 113 is provided in the vicinity of the COLD surface of the power generating element 110. This cooler 113 cools down the COLD surface of the power generating element 110.

The temperature detecting element 114 is provided adjacent to the fixing roller 107*a*. This temperature detecting element 114 detects the temperature of the surface of the fixing roller 107*a* and transmits it to the control device 115. Incidentally, the temperature detecting element 114 measures the temperature of the surface of the fixing roller 107*a* at multiple positions along the axis direction thereof including the positions facing the first heat storing plates 111 and the second heat storing plates 112.

The control device 115 controls the entire of the image forming apparatus 10. It sequentially controls operations by executing programs stored in the memory 116 according to each operation mode.

The temperature control device 115*a* provided to the control device 115 controls the output of the heater 107*b* by controlling the fixing drive circuit 122*a* provided to the PSU 122 based on the temperature transmitted from the temperature detecting element 114 to keep the temperature of the fixing device in desired target temperatures.

The target temperatures vary depending on the state such as image forming in process (in particular, fixing) and stand-by.

In addition, the control device 115 makes the memory 116 store the temperature transition of each portion of the fixing roller 107*a* during image forming corresponding to the image forming conditions such as color or monochrome printing, the identity of transfer paper (material, size, direction, etc.), a run length. Thereafter, based on the accumulated information of the temperature transition, a temperature distribution profile is created for the temperature distribution of each portion of the fixing roller 107*a* at the end of the image forming per image forming condition, which is stored in the memory 116 pairing (linked with) the image forming condition. With regard to the condition of the number of printing sheets (run length), for example, the temperature distribution at the completion of printing an image on tenth paper for a run length of 100 sheets can be utilized to deduce the temperature distribution of the completion of image forming with a run length of 10 sheets. That is, it is possible to use an image forming condition having a run length to create a temperature distribution profile linked with a condition having a different run length.

The memory 116 stores the temperature transition of the surface of the fixing roller 107*a* and the temperature distribution profile. Incidentally, the temperature distribution profile is created based on the temperature transition as described above and also a user can store arbitrary data input from outside in the profile.

MPPT 117 is a charging circuit operating when storing energy generated by the power generating element 110 in the storage battery 118. MPPT 117 is described in detail in the description of FIG. 5.

The storage battery 118 accumulates energy generated by the power generating element 110. The storage battery 118 can be recharged by other power sources.

The discharging circuit 119 converts the voltage of the power discharged by the storage battery 118 to a voltage suitable to drive the load 121.

The switching circuit 120 has a feature to supply a voltage to the load 121 by switching the power created by the PSU 122 based on the power supplied from the commercial power source 123 and the power created by the storage battery 118 and the discharging circuit 119.

The load 121 is a part driven by a power such as a motor.

The PSU 122 converts an AC power source to a DC power source and supplies it.

The fixing drive circuit 122*a* adjusts the power supplied to the heater 107*b* and is controlled by the temperature control device 115*a*.

The commercial power source 123 is an alternating current source supplied from an electric company.

One of the features of the image forming apparatus 10 described above is that the pair of the first heat storing plates 111 and the pair of the second heat storing plates to store the heat generated at the surface of the fixing roller 107*a* are provided and also switching devices to open and close the connection of the second heat scoring plates 112 and the power generating elements 110 are provided.

This feature is described below.

Figure 3:
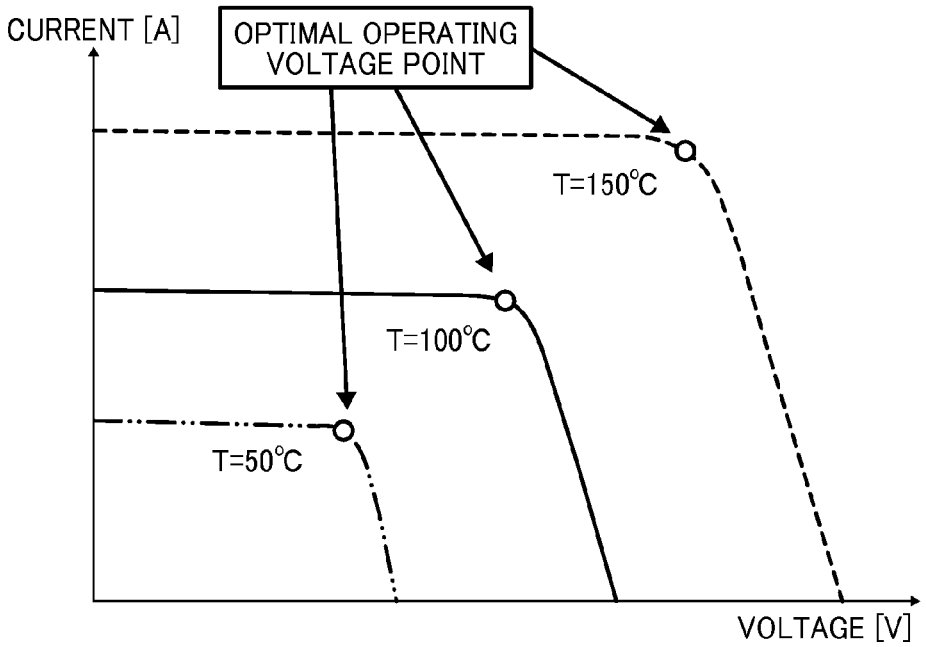
FIG. 3 is a graph illustrating current-voltage characteristics of a thermoelectric generating element.

First, the current-voltage characteristics are described referring to FIG. 3.

FIG. 3 is a graph illustrating this current-voltage characteristics. X axis represents voltage and Y axis represents current.

What is illustrated in FIG. 3 is the relation between the output voltage and the output current of a thermoelectric generating element when the temperature difference T between the HOT surface and the COLD surface thereof is 50 degrees C., 100 degrees C., or 150 degrees C. As seen in FIG. 3, the output of thermoelectric generating element differs depending on the temperature difference T. At the same temperature difference, the output current is constant until the output voltage reaches a certain value but the output current sharply drops above the certain value. The output voltage of thermoelectric generating element is maximum at this "certain value". This maximum voltage is referred to as the optimal operating voltage point. When this output voltage is applied to thermoelectric generating element, the power generation efficiency becomes high.

Figure 4:
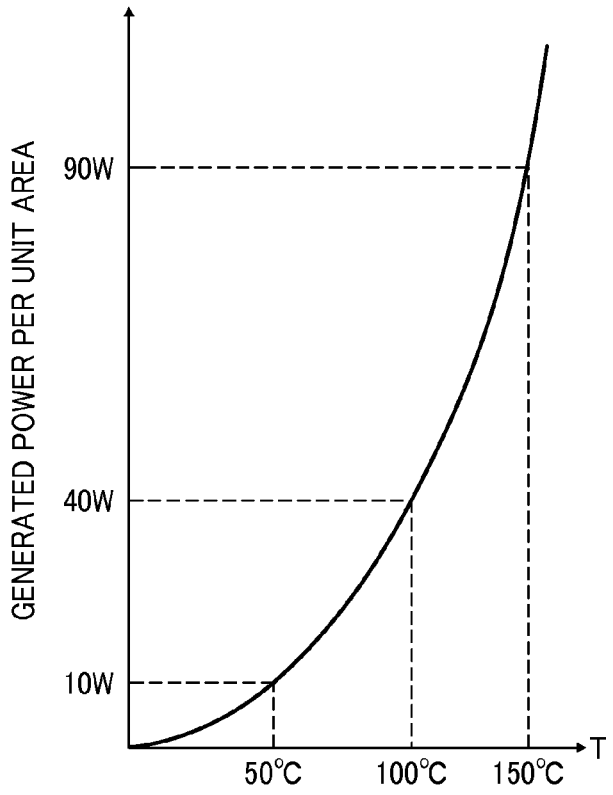
FIG. 4 is a graph illustrating temperature-power generation characteristics of a thermoelectric generating element.

Next, FIG. 4 is a graph illustrating temperature-power generation characteristics of a thermoelectric generating element.

In FIG. 4, X axis represents "the temperature difference T between the HOT surface and the COLD surface of a power generating element" and Y axis represents generated power per unit area. The temperature of the COLD surface is kept by the cooler 113. In the graph illustrated in FIG. 4, the generated power at the optimal operating voltage point is plotted at each temperature difference T illustrated in FIG. 3.

According to the graph, the generated power is 10 W when the temperature difference T is 50 degrees C., the generated power is 40 W when the temperature difference T is 100 degrees C., and the generated power is 90 W when the temperature difference T is 150 degrees C. As seen in the graph, the generated power per unit area increases directly with the square of the temperature difference T.

The behavior of the MPPT 117 provided to the image forming apparatus 10 is described next with reference to FIG. 5.

Figure 5:
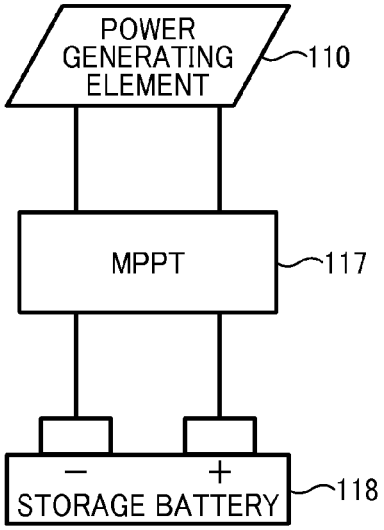
FIG. 5 is a diagram illustrating a charging path in the image forming apparatus illustrated in FIG. 2.

FIG. 5 is a diagram illustrating the charging path in the image forming apparatus 10.

As seen in FIG. 5, the electric energy generated by the power generating element 110 is stored in the storage battery 118 via the MPPT 117.

As seen in the current-voltage characteristics illustrated in FIG. 3, the voltage of the power generating element decreases as the output current increases and the voltage of the power generating element increases as the output current decreases Therefore, when the output voltage of the DC/DC converter provided to the MPPT 117 is intentionally increased, the charging current to the storage battery increases because the voltage difference with the storage battery increases. As the consequence, the input current (current taken out from the power generating element 110) to the MPPT 117 increases, so that the voltage of the power generating element drops and vice versa.

Taking advantage of this, by controlling the output voltage of the DC/DC converter, the power taken out from the power generating element is increased. The MPPT 117 has a feature of finding out the optimal operating voltage point of the power generating element 110 based on this and controls the output current (that is, the amount of charging current) of the DC/DC converter to conduct operations at this optimal operating voltage point.

The effect obtained by providing the first heat storing plate 111 and the second heat storing plate 112 and having opening and closing the connection between the first heat storing plate 111 and the second heat storing plate 112 switchable is described using several specific examples.

Prior to this, a comparative example is described which includes only one heat storing plate in the vicinity at each end of the fixing roller 107*a*.

Figure 6:
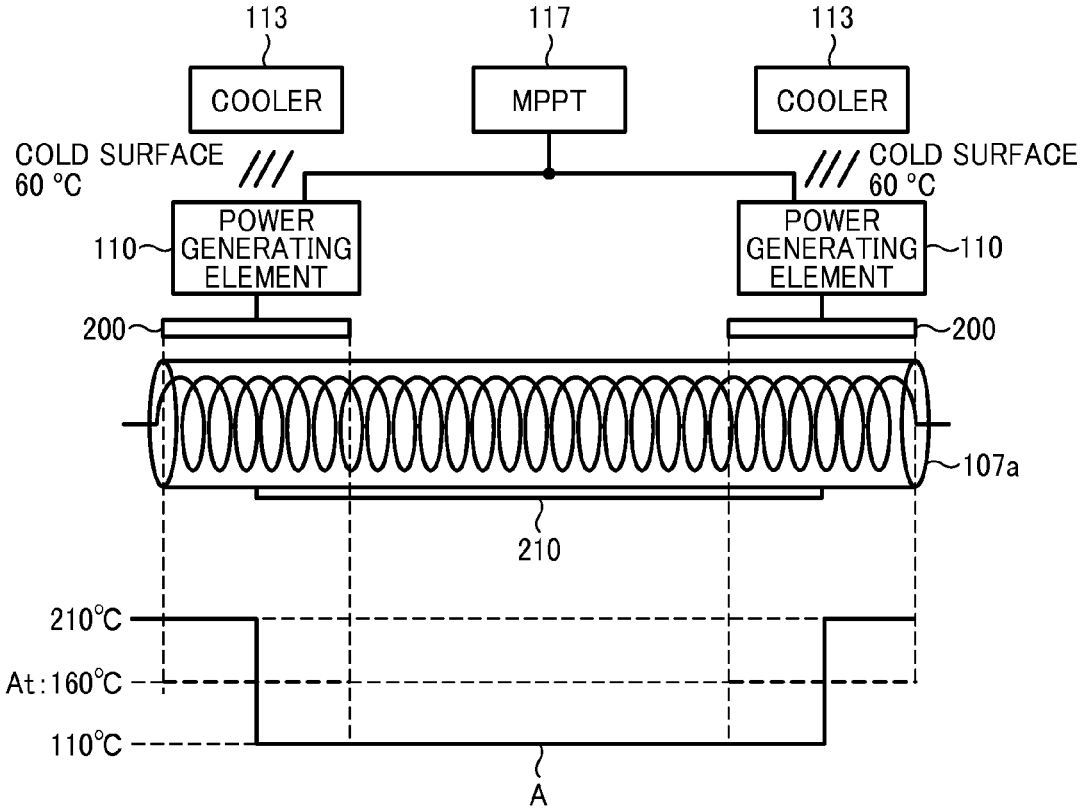
FIG. 6 is a diagram illustrating a heat supply status to a power generating element in Comparative Examples of the present disclosure described later.

FIG. 6 is a diagram illustrating the state of a heat supply to a power generating element in the comparative example. Incidentally, in FIG. 6, the same reference numerals are assigned to the configuration in common with the image forming apparatus 10 described above.

In the comparative example of FIG. 6, as described above, a heat storing plate 200 having the same area of the total of the first heat storing plate 111 and the second heat storing plate 112 is arranged closed to each of both ends of the fixing roller 107*a* corresponding to the positions of these two heat storing plates 111 and 112 and connected to the power generating element 110. However, no switch is provided to this connection. This comparative example has the same image forming apparatus 10 described above except for the structure of the heat storing plate 200 and the feature of opening and closing of the connection.

In addition, in FIG. 6, the solid line A indicates the temperature distribution profile of the surface of the fixing roller 107*a* and the dotted line At indicates the temperature of the heat transferred to the HOT surface of the power generating element 110 when the heat storing plate 200 is moved closer to the fixing roller 107*a* at the state after images are printed on a certain number of A4 transfer sheets with portrait orientation. Incidentally, the reference numeral 210 indicates the position where the transfer sheet passes during image forming.

The comparative example illustrated in FIG. 6 is rather a extreme case for convenience of description. The transfer sheet deprives the surface of the fixing roller 107*a* of heat at the position indicated by the reference numeral 210 where the transfer sheet has passed immediately after an image is formed on the transfer sheet. For this reason, the temperature thereat is lower than the other portions. In the example illustrated in FIG. 6, the temperature of the portion (the lower temperature portion) where the transfer sheet has passed is 110 degrees C. and the temperature at the other portions (higher temperature portion) is 210 degrees C.

The heat storing plate 200 is located over both areas. Therefore, the heat storing plate 200 deprives not only the high temperature portion but also the low temperature portion of heat. The temperature on the heat supplying plate 200 is uniformed and is 160 degrees C. as indicated by At. The heat of the temperature is transferred to the HOT surface of the power generating element 110.

Figure 7:
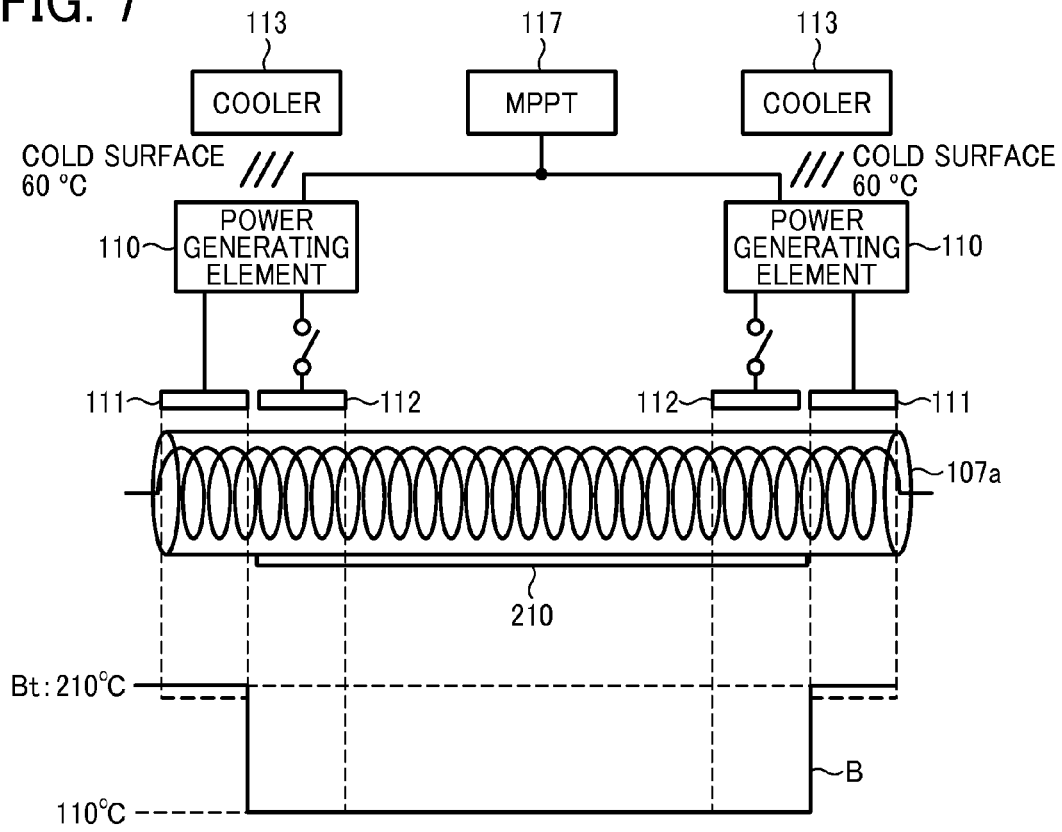
FIG. 7 is a diagram illustrating the configuration of a heat storing plate in the image forming apparatus illustrated in FIG. 1 and a heat supply status to a power generating element when a second heat storing plate is separated from the power generating element.

Next, FIG. 7 is a diagram illustrating an example of the state of heat supply to the power generating element 110 in the image forming apparatus 10 of the embodiment described using FIG. 1, etc.

This example has the same condition as described in FIG. 6 except for the heat storing plate. FIG. 7 is a diagram illustrating the state (switch disconnected) in which the second heat storing plate 112 is separated from the power generating element 110. In addition, the solid line B indicates the temperature distribution profile (same as that in FIG. 6) of the surface of the fixing roller 107*a* and the dotted line Bt indicates the temperature of the heat transferred to the HOT surface of the power generating element 110 when the first heat storing plate 111 and the second heat storing plate 112 are moved closer to the fixing roller 107*a* at the state.

In this case, since the first heat storing plate 111 deprives only the high temperature portion of heat, the heat of 210 degrees C., which is same as at the high temperature portion is transferred to the HOT surface. Incidentally, the solid line B and the dotted line Bt are shown with a alight difference in height in FIG. 7. This is to avoid overlapping of both lines. In fact, both lines represents the same temperature. This is true about the solid lines and the dotted lines in the figures below.

On the other hand, the second heat storing plate 112 stores the heat from the low temperature portion but since it is disconnected from the power generating element 110, the heat is not transferred to the power generating element 110. This is the reason the dotted line Bt is not drawn at the position corresponding to the second heat storing plate 112.

Therefore, in the example of FIG. 7, the heat of 210 degrees C., which is not uniformed, is supplied to the HOT surface of the power generating element 110. However, the area to which the heat is supplied is the area corresponding to the width of the first heat storing plate 111. To make the description easier to understand, both of the first heat storing plate 111 and the second heat storing plate 112 have the same width (area) and the half width (area) of the heat storing plate 200 but are not limited thereto.

Incidentally, the first heat storing plate 111 and the second heat storing plate 112 are not in contact with each other. However, when the second heat storing plate 112 and the power generating element 110 are connected (switch closed), the heat transferred from the first heat storing plate 111 and the second heat storing plate 112 is uniformed at the HOT surface of the power generating element 110. Therefore, when the second heat storing plate 112 and the power generating element 110 are connected, the temperature and the transfer range of the heat transferred to the HOT surface of the power generating element 110 are the same as those in illustrated in FIG. 6.

Figure 8:
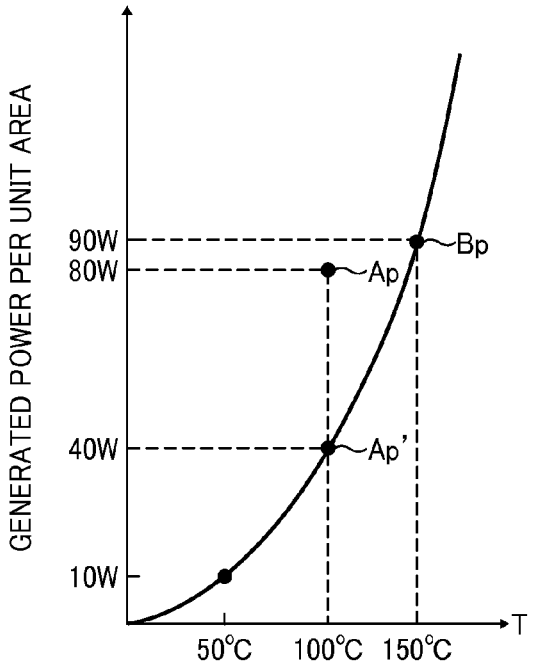
FIG. 8 is a graph illustrating power generated by the power generating element when the heat is stored in the state of FIG. 6 and FIG. 7.

Next, the generated power of the power generating element 110 in the conditions described for FIG. 6 and FIG. 7 are described with reference to FIG. 8. FIG. 8 is a graph illustrating generated power of the power generating element 110.

In FIG. 8, the graph shows the relation between the temperature difference T (X axis) of the HOT surface and the COLD surface of the power generating element 110 and the generated power (Y axis) per unit area thereof and the conditions described for FIG. 6 and FIG. 7 are plotted in the graph. The unit area here represents an area receiving the heat from a single piece of the first heat storing plate 111 (same as the second heat storing plate 112). In addition, in FIG. 8, the temperature of the COLD surface is 60 degrees C. 60 degrees C. is kept in the image forming apparatus 10 by the cooler 113.

In general, the generated power per unit area in the power generating element 110 increases directly with the square of the temperature difference T as indicated in this graph. In the condition of FIG. 7, since the temperature difference T is 150 degrees C. (210 degrees C. minus 60 degrees C.), the generated power per unit area is 90 W as indicated by the point Bp.

In the condition of FIG. 6, since the temperature difference T is 100 degrees C. (160 degrees C. minus 60 degrees C.), the generated power per unit area is 40 W as indicated by the point Ap'. However, in the condition of FIG. 6, the area in which the power generating element 110 is capable of generating power is twice as large as in FIG. 7 reflecting the area of the heat storing plates serving as the heat transfer source. Therefore, the generated power of the entire of the power generating element 110 is 80 W (40×2) as indicated by the point Ap.

When both are compared, a larger generated power is obtained in the condition of FIG. 7. That is, it is found that a larger generated power is obtained by dividing a heat storing plate and separating one of the divided plate from the power generating element 110 although the area capable of generating power is smaller. This is because, according to the relation of the square proportion between the temperature difference T and the generated power, the generated power is larger in some cases when the power is generated by storing heat from the portion having a large temperature difference T in a concentration manner.

Taking into account what is described above, the state of heat supply to the power generating element 110 in various situations in the image forming apparatus of an embodiment of the present disclosure are described. Incidentally, the structure and conditions of each part illustrated in the figures later corresponding to FIG. 7 illustrating the state of heat supply to the power generating element 110 are the same as those in FIG. 7 unless otherwise specified. The conditions different from those in FIG. 7 are specified in each occasion.

Figure 9:
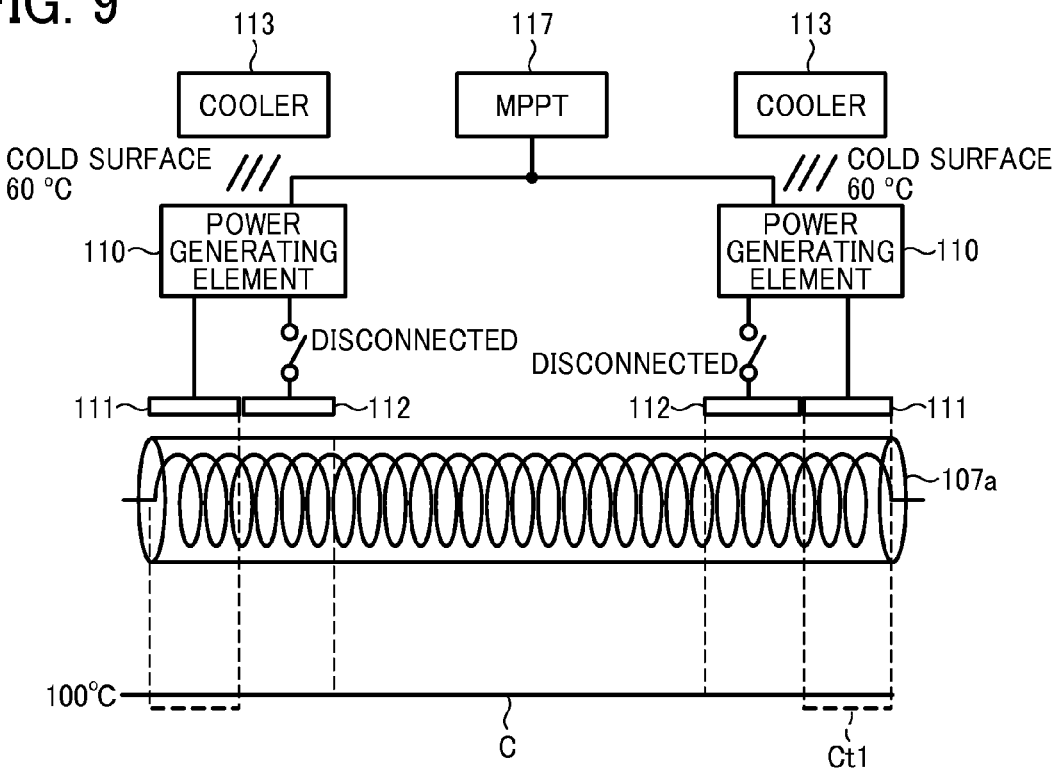
Figure 10:
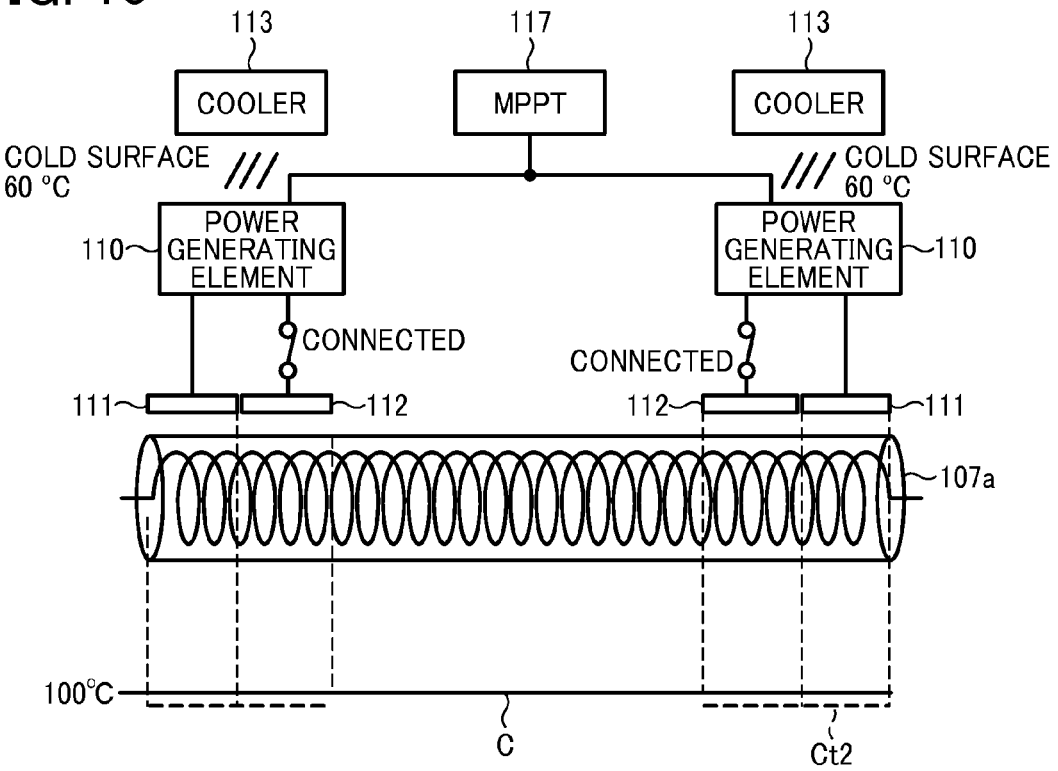
FIG. 10 is a diagram illustrating an example of the heat supplying status to a power generating element when a second heat storing plate is connected with the power generating element while the image forming apparatus stands by as illustrated in FIG. 9.

First, the state of heat supply to the power generating element 110 when the image forming apparatus 10 stands by is described with reference to FIG. 9 and FIG. 10. The difference between FIG. 9 and FIG. 10 is whether the second heat storing plate 112 is separated from or connected with the power generating element 110. FIG. 9 illustrates the case in which these are separated and FIG. 10 illustrates the case in which these are connected.

In addition, in FIG. 9 and FIG. 10, the temperature distribution profile of the surface of the fixing roller 107*a* is represented by the solid line C. Unlike the case in FIG. 7, since the image forming apparatus 10 is stands by, the temperature of the fixing roller 107*a* is relatively low and 100 degrees C. in the entire area.

In addition, in FIG. 9, the dotted line Ct1 indicates the temperature of the heat transferred to the HOT surface of the power generating element 110 when the first heat storing plate 111 is moved closer to the fixing roller 107*a* in the state indicated by the solid line C.

The first heat storing plate 111 deprives the portion of 100 degrees C. of heat and the heat of 100 degrees C. is transferred to the HOT surface of the power generating element 110. On the other hand, since the second heat storing plate 112 is separated from the power generating element 110, the stored heat is not transferred to the HOT surface of the power generating element 110.

In FIG. 10, the dotted line Ct2 indicates the temperature of the heat transferred to the HOT surface of the power generating element 110 when the first heat storing plate 111 and the second heat storing plate 112 are moved closer to the fixing roller 107*a* in the state indicated by the solid line C.

The state of heat supply to the power generating element 110 by the first heat storing plate 111 is the same as in FIG. 9. In addition, since the second heat storing plate 112 is connected with the power generating element 110, the stored heat of 100 degrees C. by the second heat storing plate 112 is also transferred to the HOT surface of the power generating element 110.

Figure 11:
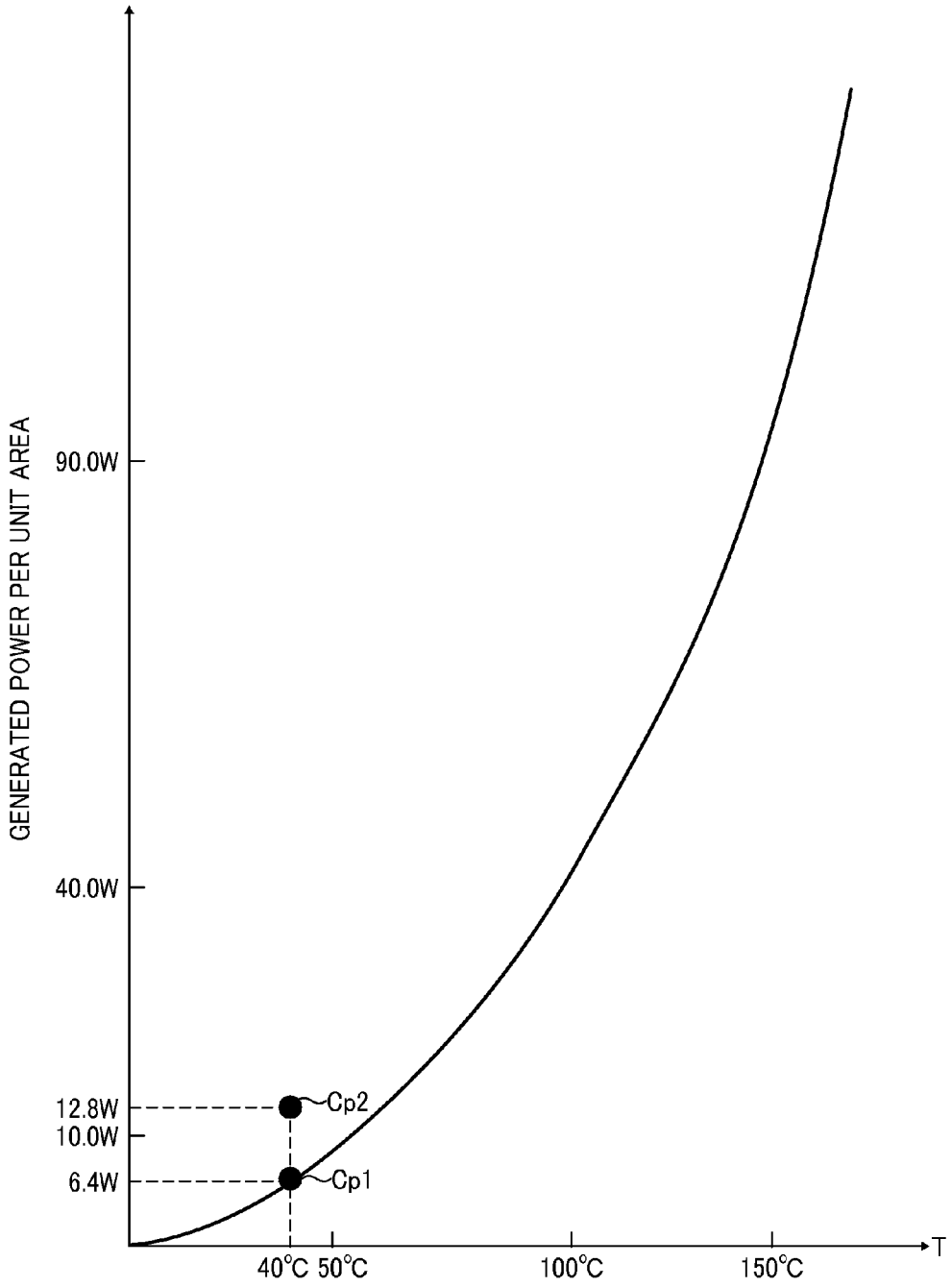
FIG. 11 is a graph illustrating generated power when the heat is stored in the state of FIG. 9 and FIG. 10.

FIG. 11 is a graph to describe the generated power of the power generating element 110 in the conditions described for FIG. 9 and FIG. 10. The description of the FIG. 8 is applied to the graph.

In the condition of FIG. 9, since the temperature difference T is 40 degrees C. (100 degrees C. minus 60 degrees C.), the generated power per unit area is 6.4 W as indicated by the point Cp1.

This is the same as in the conditions for FIG. 10. However, in FIG. 10, the area in which the power generating element 110 is capable of generating power is twice as large as in FIG. 9 since the second heat storing plate 112 is connected. Therefore, the generated power of the entire of the power generating element 110 is 12.8 W (6.4×2) as indicated by the point Cp2.

When both are compared, a larger generated power is obtained in the condition of FIG. 10.

That is, when the temperature of the heat stored by the first heat storing plate 111 and the second heat storing plate 112 is the same, it is found that a larger generated power is obtained when the first heat storing plate 111 and the second heat storing plate 112 are connected to increase the area in which the power generating element 110 is capable of generating power.

Figure 12:
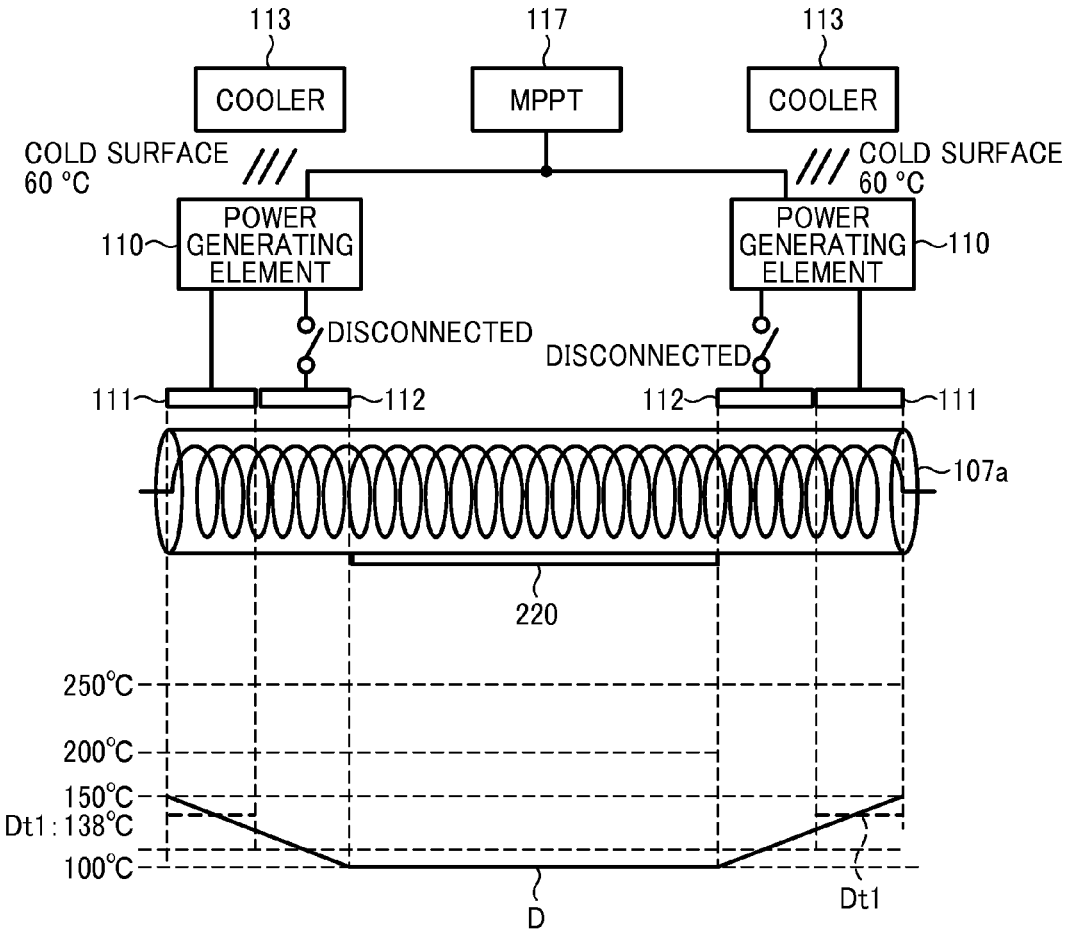
FIG. 12 is a diagram illustrating an example of the heat supplying status to a power generating element when a second heat storing plate is separated from the power generating element after printing images on ten sheets of B5 size transfer paper.

Next, the state of heat supply to the power generating element 110 after the image forming apparatus 10 has printed images on 10 B5 transfer sheets is described with reference to FIG. 12 and FIG. 13. FIG. 12 illustrates the case in which the second heat storing plate 112 is disconnected (separated) from the power generating element 110 and FIG. 13 illustrates the case in which these are connected.

Figure 13:
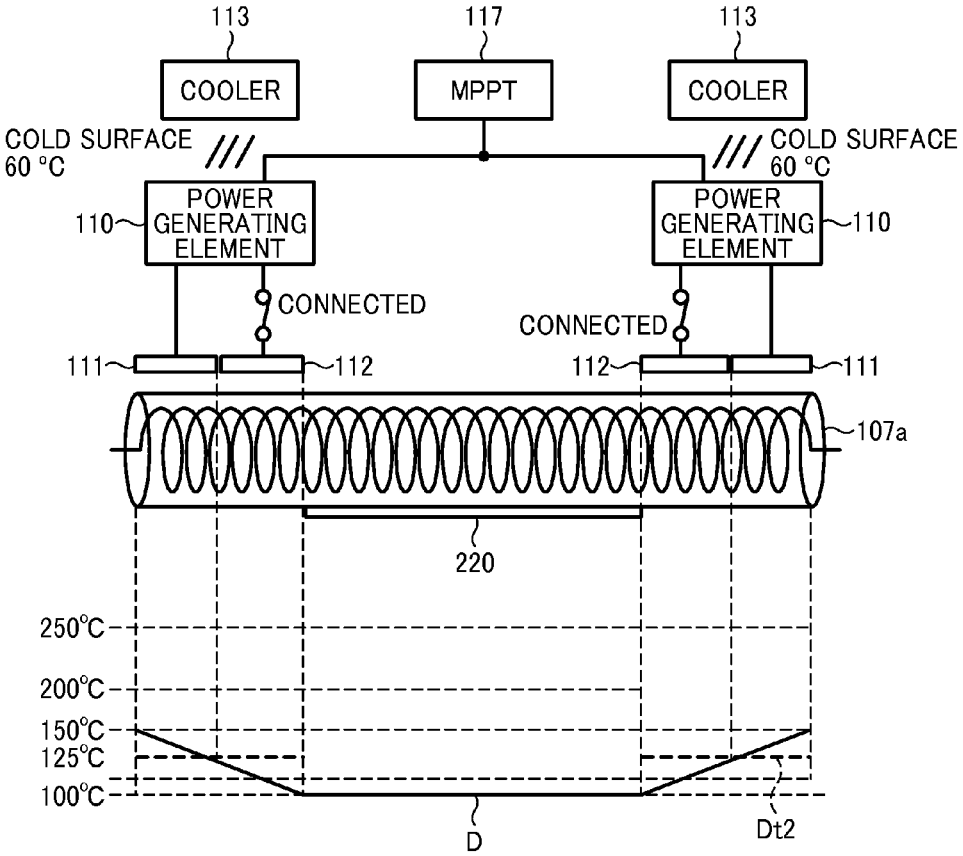
FIG. 13 is a diagram illustrating an example of the heat supplying status to a power generating element when a second heat storing plate is connected with the power generating element after printing images as illustrated in FIG. 12.

In addition, in FIG. 12 and FIG. 13, the reference numeral 220 indicates the position where the transfer sheet has passed during printing and the solid line D indicates the temperature distribution profile of the surface of the fixing roller 107*a*.

Since this example is after printing, the temperature of the range through which the transfer sheets have passed is lower than the other portions. The temperature distribution profiles in FIG. 12 and FIG. 13 are closer to the real situation than the case in FIG. 7. The temperature of the surface of the fixing roller 107*a* is 100 degrees C. at the position 220 where the transfer sheets have passed, rises gradually toward the end portion, and 150 degrees C. at both ends.

In FIG. 12, the dotted line Dt1 indicates the temperature of the heat transferred to the HOT surface of the power generating element 110 when the first heat storing plate 111 is moved closer to the fixing roller 107*a* in the state indicated by the solid line D.

The first heat storing plate 111 stores the heat from the portion of the surface of the fixing roller 107*a* in a temperature range of from about 125 degrees C. to about 150 degrees C. The heat of about 138 degrees C., which is the average of those temperatures, is supplied to the power generating element 110. On the other hand, since the second heat storing plate 112 is disconnected from the power generating element 110, the stored heat is not transferred to the HOT surface of the power generating element 110.

In FIG. 13, the dotted line Dt2 indicates the temperature of the heat transferred to the HOT surface of the power generating element 110 when the first heat storing plate 111 and the second heat storing plate 112 are moved closer to the fixing roller 107*a* in the state indicated by the solid line D.

The state of heat supply to the power generating element 110 by the first heat storing plate 111 is the same as in FIG. 12. The first heat storing plate 112 stores the heat from the portion of the surface of the fixing roller 107*a* in a temperature range of from about 100 degrees C. to about 125 degrees C. In addition, since the second heat storing plate 112 is connected with the power generating element 110, the heat of about 113 degrees C., which is the average of those temperatures, is supplied to the HOT surface of the power generating element 110.

In the HOT surface of the power generating element 110, as in the case illustrated in FIG. 7, the heat transferred from the first heat storing plate 111 and the heat transferred from the second heat storing plate 112 are averaged. As a whole, the heat of the average temperature 125 degrees C. is transferred to the HOT surface of the power generating element 110.

Figure 14:
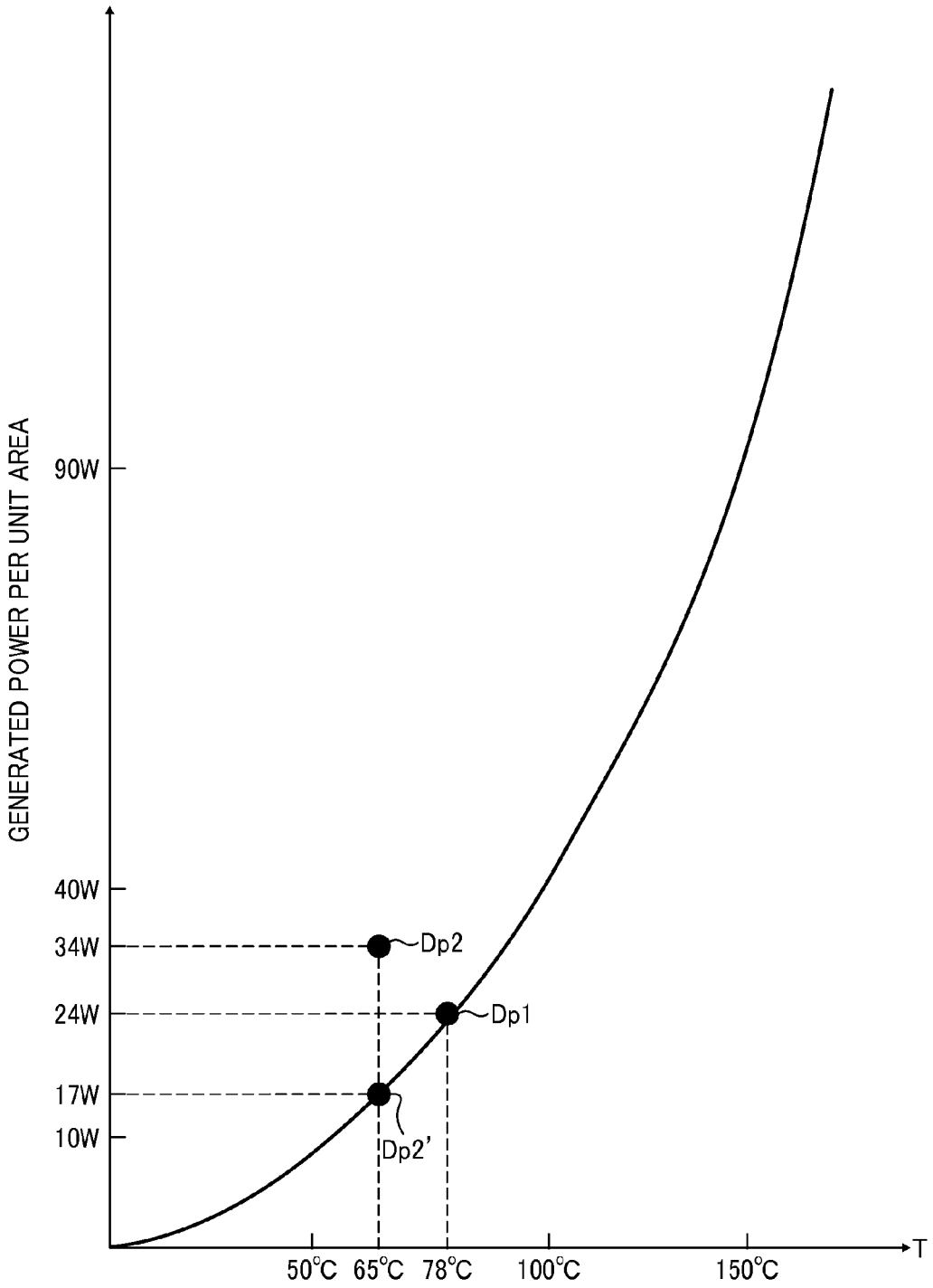
FIG. 14 is a graph illustrating generated power when the heat is stored in the state of FIG. 12 and FIG. 13.

FIG. 14 is a graph to describe the generated power of the power generating element 110 in the conditions described for FIG. 12 and FIG. 13. The description of the graph is the same as for FIG. 8.

In the condition of FIG. 12, since the temperature difference T is 78 degrees C. (138 degrees C. minus 60 degrees C.), the generated power per unit area is 24 W as indicated by the point Dp1.

In the condition of FIG. 13, since the temperature difference T is 65 degrees C. (125 degrees C. minus 60 degrees C.), the generated power per unit area is 17 W as indicated by the point Dp2'. However, in FIG. 13, the area in which the power generating element 110 is capable of generating power is twice as large as in FIG. 12 since the second heat storing plate 112 is connected. Therefore, the generated power of the entire of the power generating element 110 is 34 W (17×2) as indicated by the point Dp2.

When both are compared, a larger generated power is obtained in the condition of FIG. 13.

That is, when the temperature of the heat stored by the first heat storing plate 111 is not so much higher than the temperature of the heat stored by the second heat storing plate 112, it is found that a larger generated power is obtained when the second heat storing plate 112 is connected with the power generating element 110.

Figure 15:
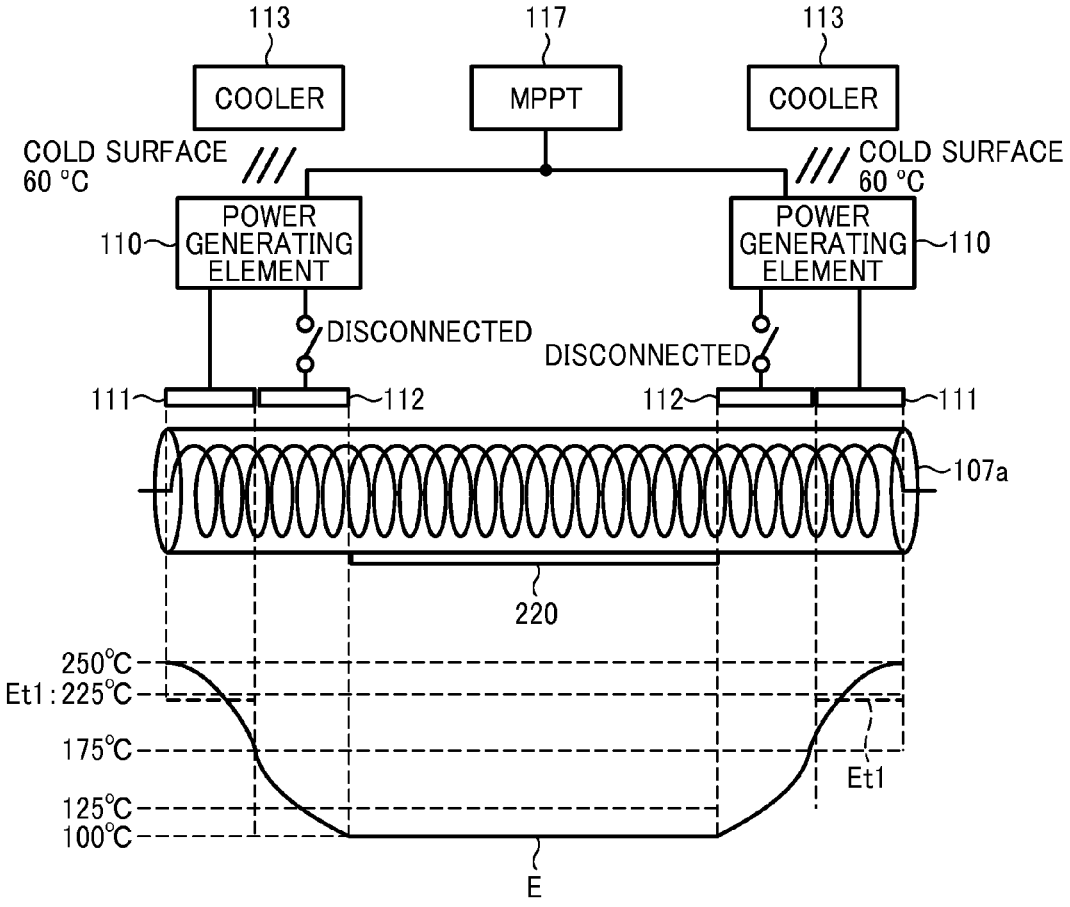
FIG. 15 is a diagram illustrating an example of the heat supplying status to a power generating element when a second heat storing plate is separated from the power generating element after printing images on 100 sheets of B5 size transfer paper.

Next, the state of heat supply to the power generating element 110 after the image forming apparatus 100 has printed images on 10 B5 transfer sheets is described with reference to FIG. 15 and FIG. 16. FIG. 15 illustrates the case in which the second heat storing plate 112 is disconnected (separated) from the power generating element 110 and FIG. 16 illustrates the case in which these are connected.

Figure 16:
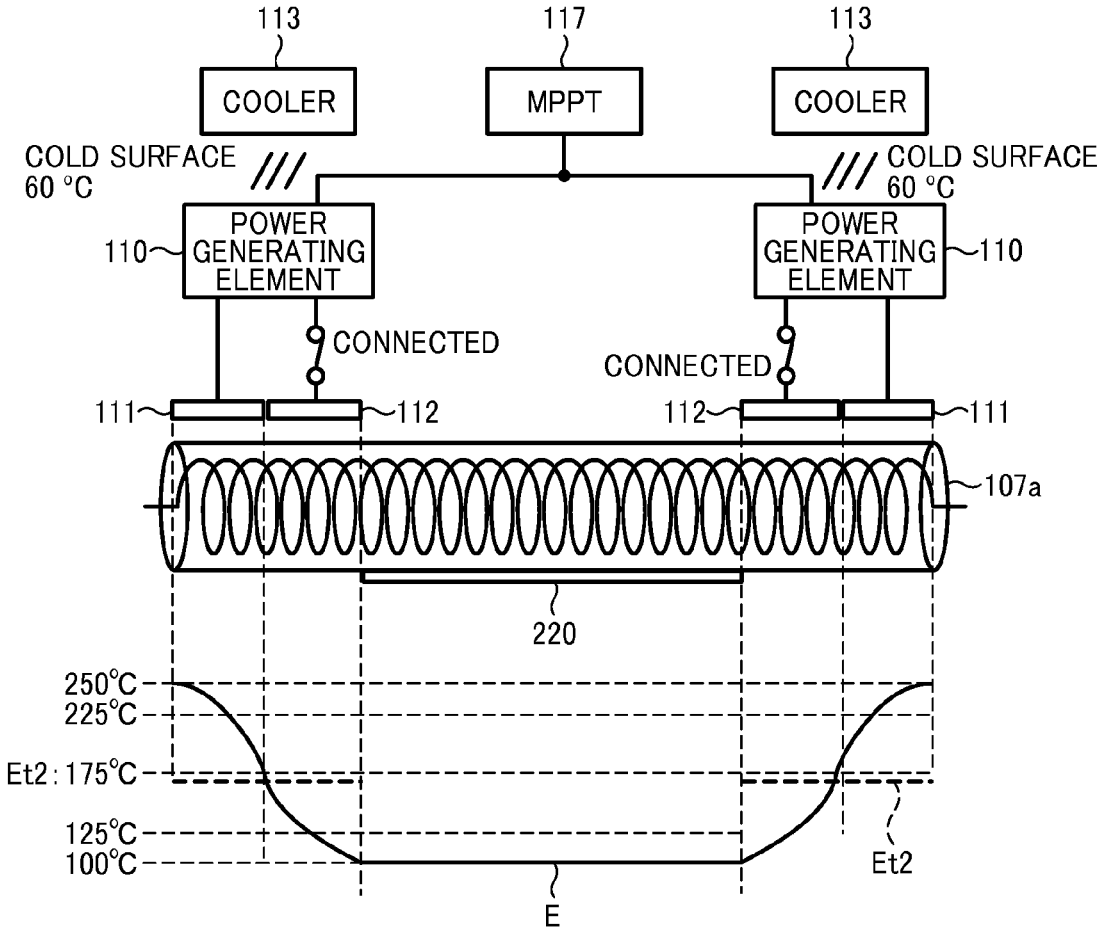
FIG. 16 is a diagram illustrating an example of the heat supplying status to a power generating element when a second heat storing plate is connected with the power generating element after printing images as illustrated in FIG. 15.

In addition, in FIG. 15 and FIG. 16, the reference numeral 220 indicates the position where the transfer sheets have passed during printing and the solid line E indicates the temperature distribution profile of the surface of the fixing roller 107*a*.

Since this example is also after printing, the temperature of the range through which the transfer sheets have passed is lower than the other portions. In addition, since the run length is more than in the case of FIG. 12 or FIG. 13, the temperature difference between the area through which the transfer sheets have passed and the other portions is large and the temperature gradient is steep. That is, the temperature of the surface of the fixing roller 107*a* is 100 degrees C. at the position 220 where the transfer sheets have passed, rises gradually toward the end, and 250 degrees C. at both ends.

In FIG. 15, the dotted line Et1 indicates the temperature of the heat transferred to the HOT surface of the power generating element 110 when the first heat storing plate 111 is moved closer to the fixing roller 107*a* in the state indicated by the solid line E.

The first heat storing plate 111 stores the heat from the portion of the surface of the fixing roller 107*a* in a temperature range of from about 175 degrees C. to about 250 degrees C. The heat of about 225 degrees C., which is the average of those temperatures, is supplied to the power generating element 110. On the other hand, since the second heat storing plate 112 is disconnected from the power generating element 110, the stored heat is not transferred to the HOT surface of the power generating element 110.

In FIG. 16, the dotted line Et2 indicates the temperature of the heat transferred to the HOT surface of the power generating element 110 when the first heat storing plate 111 and the second heat storing plate 112 are moved closer to the fixing roller 107*a* in the state indicated by the solid line E.

The state of heat supply to the power generating element 110 by the first heat storing plate 111 is the same as in FIG. 15. The first heat storing plate 112 stores the heat from the portion of the surface of the fixing roller 107*a* in a temperature range of from about 100 degrees C. to about 175 degrees C. In addition, since the second heat storing plate 112 is connected with the power generating element 110, the heat of about 125 degrees C., which is the average of those temperatures, is supplied to the HOT surface of the power generating element 110.

In the HOT surface of the power generating element 110, as in the case illustrated in FIG. 7, the heat transferred from the first heat storing plate 111 and the heat transferred from the second heat storing plate 112 are averaged. As a whole, the heat of the average temperature 175 degrees C. is transferred to the HOT surface of the power generating element 110.

Figure 17:
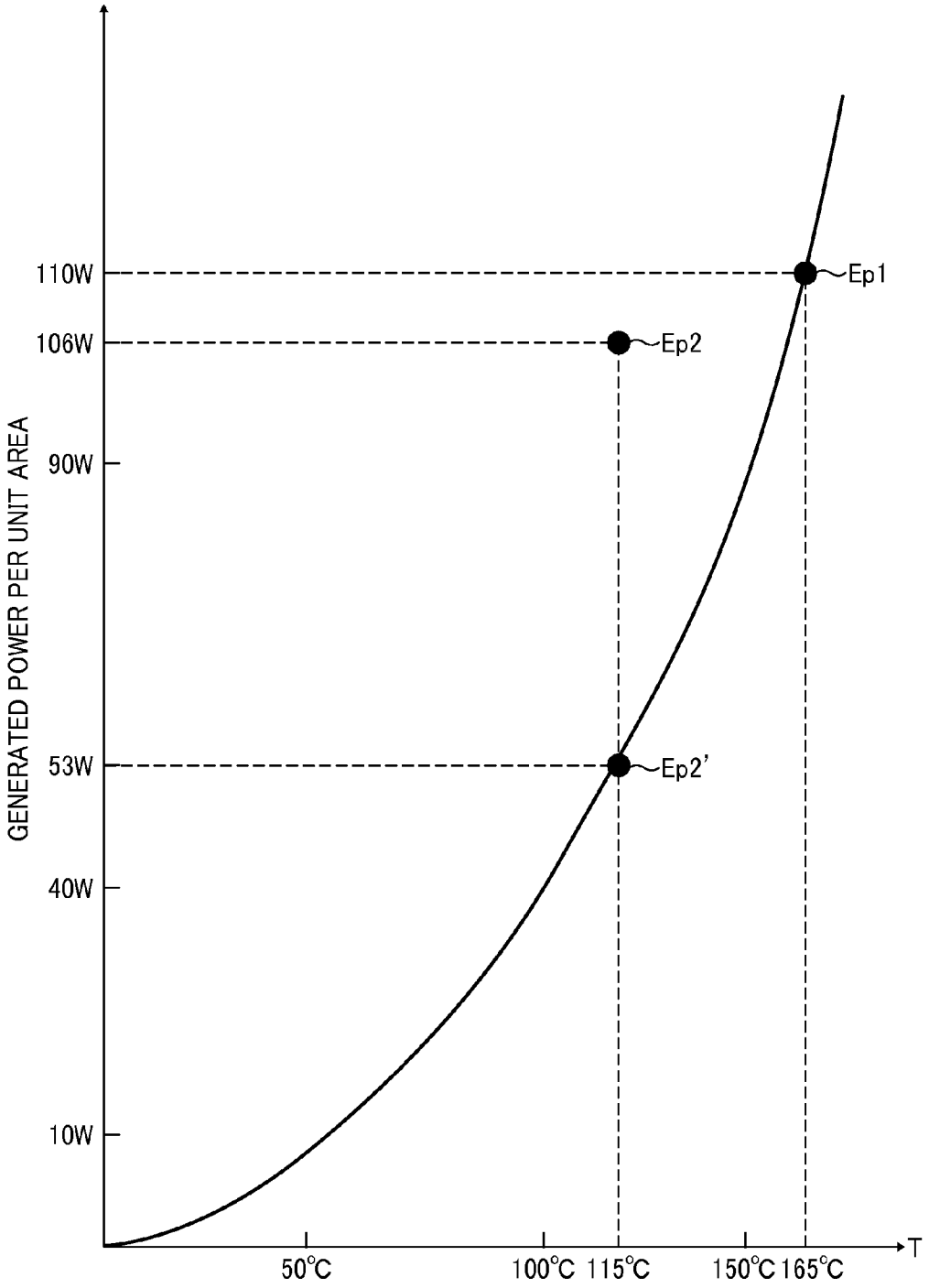
FIG. 17 is a graph illustrating generated power when the heat is stored in the state of FIG. 15 and FIG. 16.

FIG. 17 is a graph to describe the generated power of the power generating element 110 in the conditions described for FIG. 15 and FIG. 16. The description of the graph is the same as for FIG. 8.

In the condition of FIG. 15, since the temperature difference T is 165 degrees C. (225 degrees C. minus 60 degrees C.), the generated power per unit area is 110 W as indicated by the point Ep1.

In the condition of FIG. 16, since the temperature difference T is 115 degrees C. (175 degrees C. minus 60 degrees C.), the generated power per unit area is 53 W as indicated by the point Dp2'. However, in FIG. 16, the area in which the power generating element 110 is capable of generating power is twice as large as in FIG. 15 since the second heat storing plate 112 is connected. Therefore, the generated power of the entire of the power generating element 110 is 106 W (53×2) as indicated by the point Ep2.

When both are compared, a larger generated power is obtained in the condition of FIG. 15.

That is, when the temperature of the heat stored by the first heat storing plate 111 is higher than the temperature of the heat stored by the second heat storing plate 112, it is found that a larger generated power is obtained when the second heat storing plate 112 is disconnected with the power generating element 110 to increase the area in which the power generating element 110 is capable of generating power.

That is, when the temperature of the heat stored by the first heat storing plate 111 is sufficiently high in comparison with the temperature of the heat stored by the second heat storing plate 112, the generated power is larger when the second heat storing plate 112 is disconnected from the power generating element 110. In addition, in the other cases, the generated power is larger when the second heat storing plate 112 is connected with the power generating element 110.

The factor having an impact on the temperature distribution profile of the fixing roller 107*a* is not limited to the run length of a print job. For example, the width of transfer paper has an impact on the profile. Next, this point is described.

Figure 18:
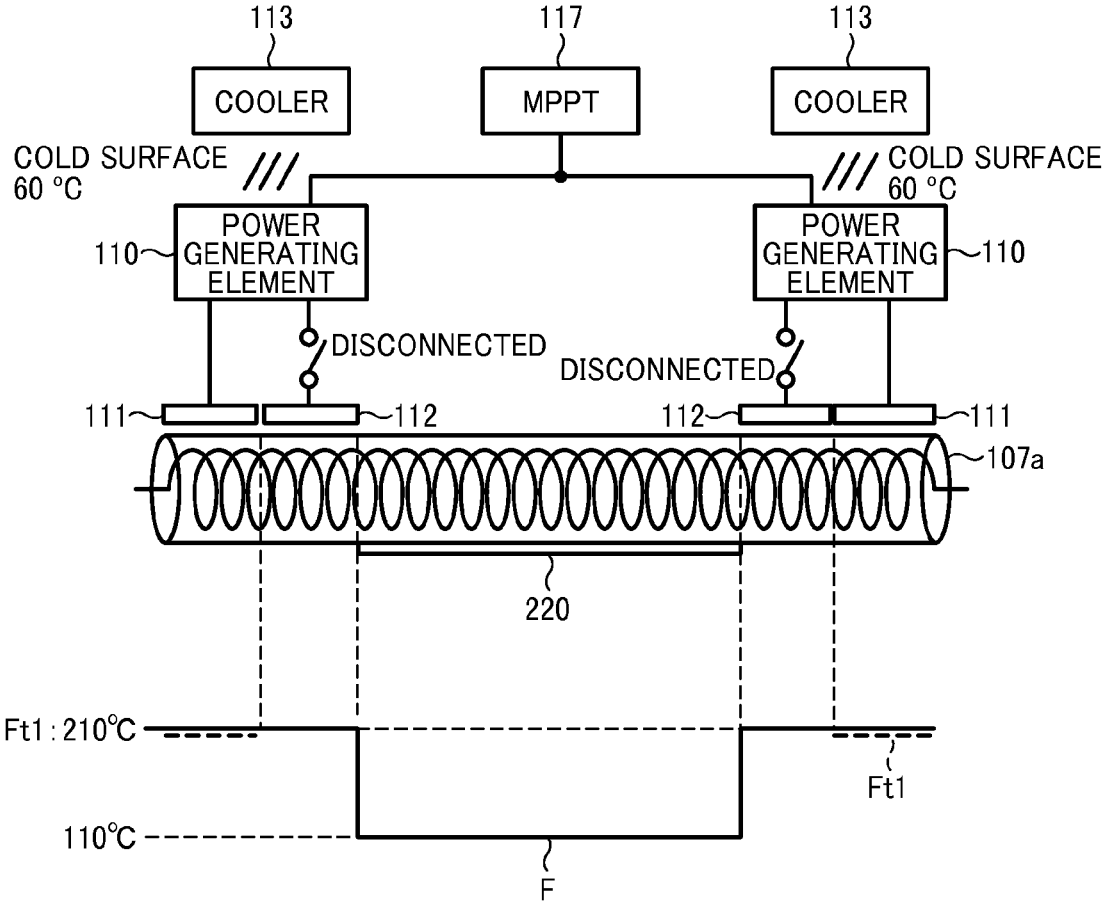
FIG. 18 is a diagram illustrating an example of the heat supply status to a power generating element when a second heat storing plate is separated from the power generating element after printing images on B5 size transfer paper.
Figure 19:
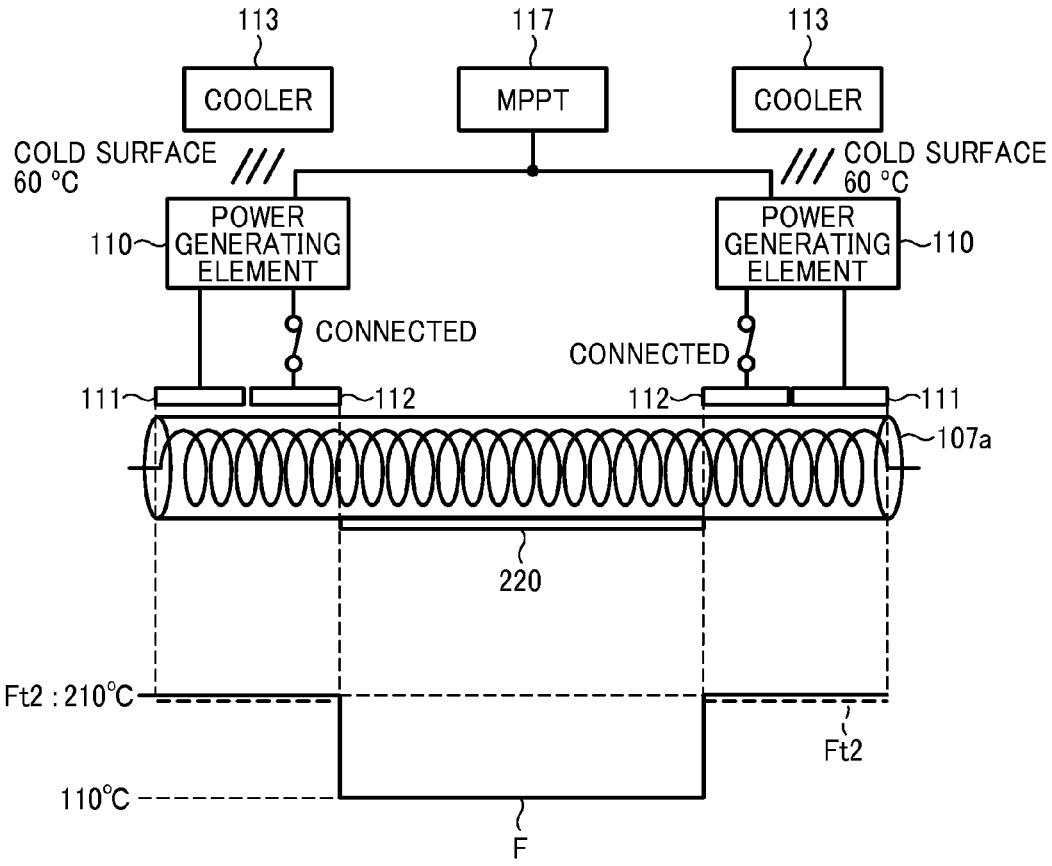
FIG. 19 is a diagram illustrating an example of the heat supply status to a power generating element when a second heat storing plate is connected with the power generating element after printing images as illustrated in FIG. 18.

First, the state of heat supply to the power generating element 110 after a preset number of B5 transfer sheets with a portrait orientation are used for printing is described with reference to FIG. 18 and FIG. 19. FIG. 18 is a diagram illustrating a case in which the second heat storing plate 112 is disconnected with the power generating element 110 and FIG. 19 is a diagram illustrating a case in which these are connected. In addition, in FIG. 18 and FIG. 19, the reference numeral 220 indicates the position where the transfer sheets have passed during printing and the solid line F indicates the temperature distribution profile of the surface of the fixing roller 107*a*.

Since this example is also after printing, the temperature of the range through which the transfer paper has passed is lower than the other portions. FIG. 18 and FIG. 19 represent schematic profiles as in the case illustrated in FIG. 7 to make the difference of the power generation efficiency by the size of transfer paper easily understood. The temperature sharply changes between the low temperature portion (110 degrees C.) in the range through which the transfer paper has passed and the other high temperature portion (210 degrees C.).

In addition, in FIG. 18, the dotted line Ft1 indicates the temperature of the heat transferred to the HOT surface of the power generating element 110 when the first heat storing plate 111 is moved closer to the fixing roller 107*a* in the state indicated by the solid line F.

The first heat storing plate 111 deprives the high temperature portion having 210 degrees C. of heat and this heat is transferred to the HOT surface of the power generating element 110. On the other hand, since the second heat storing plate 112 is disconnected with the power generating element 110, the stored heat is not transferred to the HOT surface of the power generating element 110.

In FIG. 19, the dotted line Ft2 indicates the temperature of the heat transferred to the HOT surface of the power generating element 110 when the first heat storing plate 111 and the second heat storing plate 112 are moved closer to the fixing roller 107*a* in the state indicated by the solid line F.

The state of heat supply to the power generating element 110 by the first heat storing plate 111 is the same as in FIG. 19. In addition, the second heat storing plate 112 is connected and stores the heat from the high temperature portion having 210 degrees C. like the first heat storing plate 111. This heat is transferred to the HOT surface of the power generating element 110. In the HOT surface of the power generating element 110, the heat transferred from the first heat storing plate 111 and the heat transferred from the second heat storing plate 112 are averaged. As a whole, the heat of the average temperature 210 degrees C. is transferred to the HOT surface of the power generating element 110.

Figure 20:
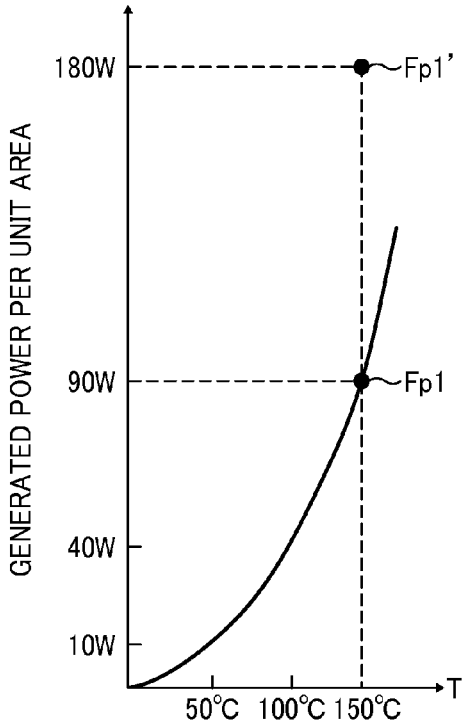
FIG. 20 is a graph illustrating generated power when the heat is stored in the state of FIG. 18 and FIG. 19.

FIG. 20 is a graph to describe the generated power of the power generating element 110 in the conditions described for FIG. 18 and FIG. 19. The description of the FIG. 8 is applied to the graph.

In the condition of FIG. 18 and FIG. 19, since the temperature difference T is 150 degrees C. (210 degrees C. minus 60 degrees C.), the generated power per unit area is 90 W as indicated by the point Fp1.

However, in FIG. 19, the area in which the power generating element 110 is capable of generating power is twice as large as in FIG. 18 since the second heat storing plate 112 is connected. Therefore, the generated power of the entire of the power generating element 110 is 180 W (90×2) as indicated by the point Fp1'.

Therefore, the generated power is found to be larger when the second heat storing plate 112 is connected with the power generating element 110.

Figure 21:
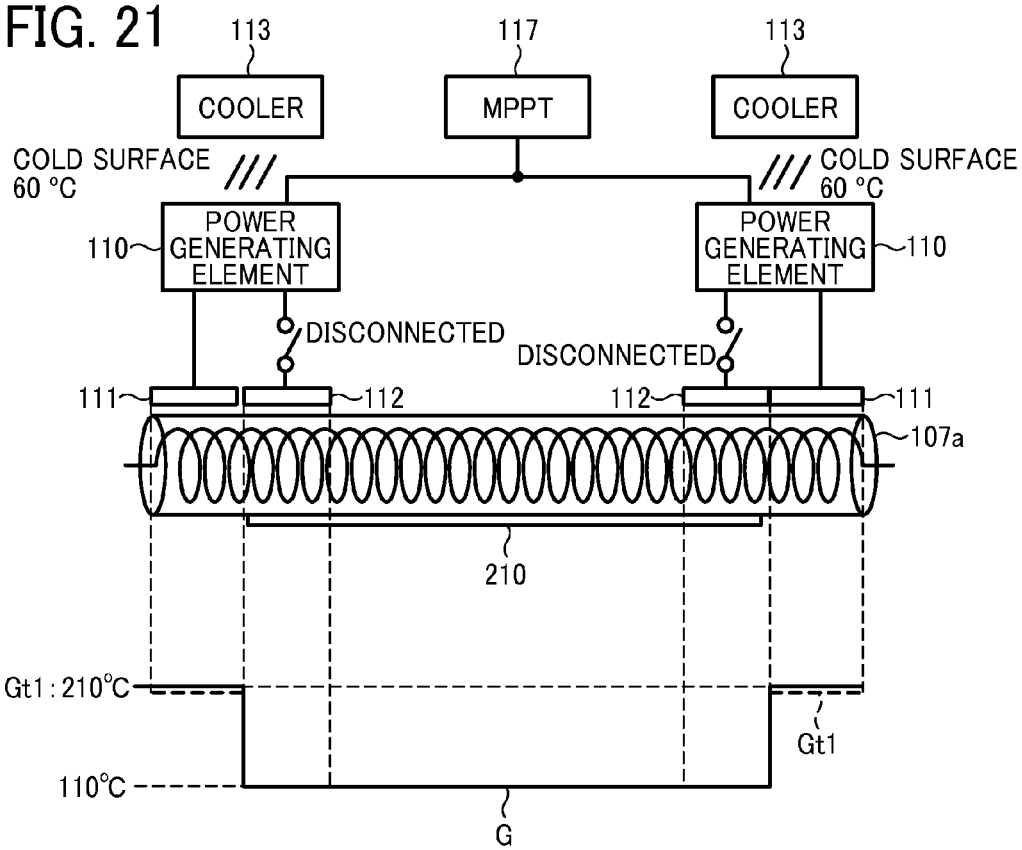
FIG. 21 is a diagram illustrating an example of the heat supply status to a power generating element when a second heat storing plate is separated from the power generating element after printing images on A4 size transfer paper.
Figure 22:
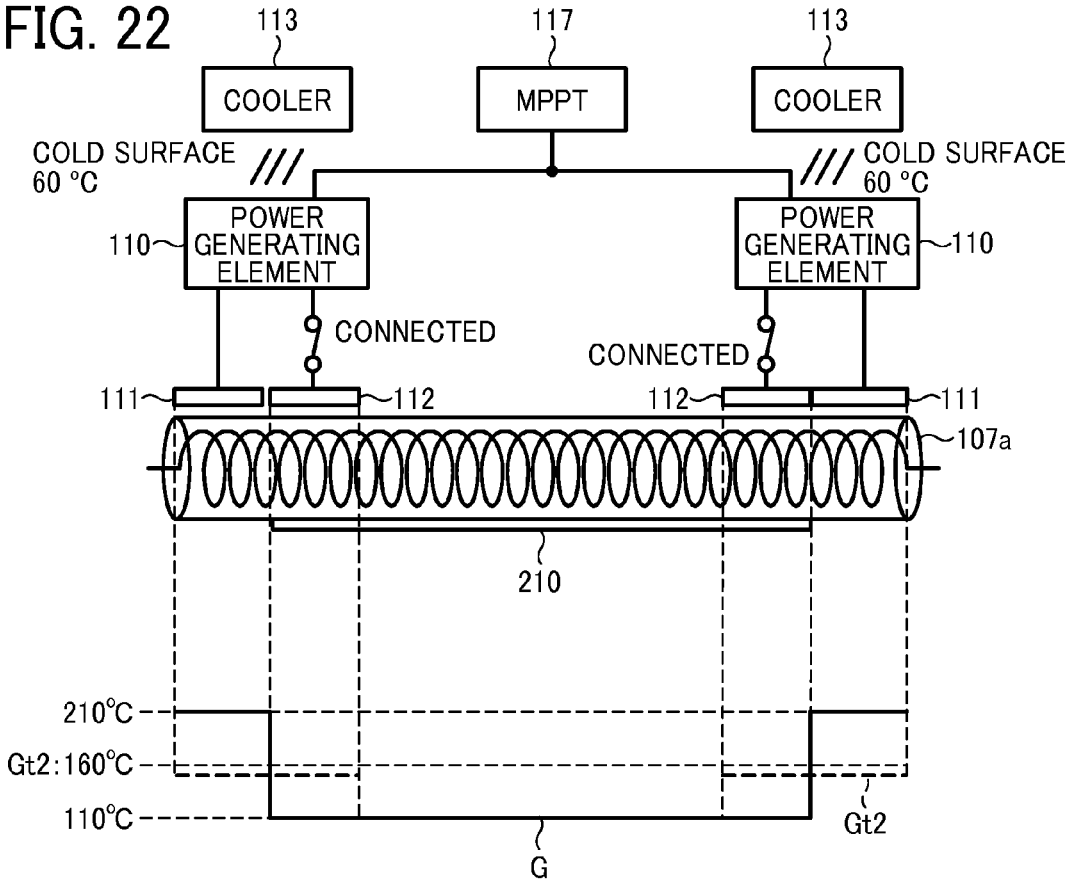
FIG. 22 is a diagram illustrating an example of the heat supply status to a power generating element when a second heat storing plate is connected with the power generating element after printing images as illustrated in FIG. 21.

Next, the state of heat supply to the power generating element 110 after a preset number of A4 transfer sheets with a portrait orientation are used for printing is described with reference to FIG. 21 and FIG. 22. FIG. 21 is a diagram illustrating a case in which the second heat storing plate 112 is disconnected with the power generating element 110 and FIG. 22 is a diagram illustrating a case in which these are connected. In addition, in FIG. 21 and FIG. 22, the reference numeral 210 indicates the position where the transfer sheet has passed during printing and the solid line G indicates the temperature distribution profile of the surface of the fixing roller 107*a*.

Since this example is also after printing, the temperature of the range through which the transfer sheet has passed is lower than the other portions. FIG. 21 and FIG. 22 represent schematic profiles as in the case illustrated in FIG. 7. The temperature sharply changes between the low temperature portion (110 degrees C.) in the range through which the transfer paper has passed and the other high temperature portion (210 degrees C.)

In addition, in FIG. 21, the dotted line Gt1 indicates the temperature of the heat transferred from the HOT surface of the power generating element 110 when the first heat storing plate 111 is moved closer to the fixing roller 107*a* in the state indicated by the solid line G.

The first heat storing plate 111 deprives the high temperature portion having 210 degrees C. of heat and this heat is transferred to the HOT surface of the power generating element 110. On the other hand, since the second heat storing plate 112 is disconnected with the power generating element 110, the stored heat is not transferred to the HOT surface of the power generating element 110.

In FIG. 22, the dotted line Gt2 indicates the temperature of the heat transferred to the HOT surface of the power generating element 110 when the first heat storing plate 111 and the second heat storing plate 112 are moved closer to the fixing roller 107*a* in the state indicated by the solid line G.

The state of heat supply to the power generating element 110 by the first heat storing plate 111 is the same as in FIG. 21. In addition, the second heat storing plate 112 is connected and stores the heat from the high temperature portion having 110 degrees C. This heat is transferred to the HOT surface of the power generating element 110. In the HOT surface of the power generating element 110, the heat transferred from the first heat storing plate 111 and the heat transferred from the second heat storing plate 112 are averaged. As a whole, the heat of the temperature 160 degrees C. is transferred to the HOT surface of the power generating element 110.

Figure 23:
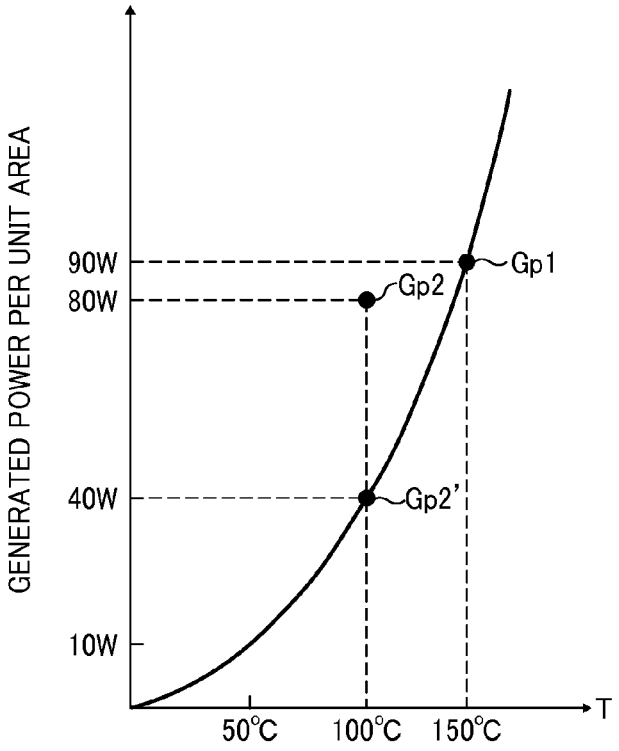
FIG. 23 is a graph illustrating generated power when the heat is stored in the state of FIG. 21 and FIG. 22.

FIG. 23 is a graph illustrated to describe the generated power of the power generating element 110 in the conditions described for FIG. 21 and FIG. 22. The description of the FIG. 8 is applied to the graph.

In the condition of FIG. 21, since the temperature difference T is 150 degrees C. (210 degrees C. minus 60 degrees C.), the generated power per unit area is 90 W as indicated by the point Gp1.

In the condition of FIG. 22, since the temperature difference T is 100 degrees C. (160 degrees C. minus 60 degrees C.), the generated power per unit area is 40 W as indicated by the point Gp2'. However, in FIG. 22, the area in which the power generating element 110 is capable of generating power is twice as large as in FIG. 23 since the second heat storing plate 112 is connected. Therefore, the generated power of the entire of the power generating element 110 is 80 W (40×2) as indicated by the point Gp2.

Therefore, the generated power is found to be larger when the second heat storing plate 112 is disconnected with the power generating element 110.

When the two examples are compared, it is found that whether the second heat storing plate 112 is connected or disconnected with the power generating element 110 depends on the width of transfer paper for use in printing.

Both the run length for printing described above and the width of transfer paper are included in the print setting information indicating the content of a print job to be executed. Therefore, for every content (classified into multiple classes for each parameter) of print setting information, the temperature distribution profile of the fixing roller 107*a* after executing the print job of the content is stored in the image forming apparatus 10 in advance. Thereafter, when executing the print job, whether the second heat storing plate 112 and the power generating element 110 is connected or disconnected is controlled based on the temperature distribution profile linked with the print setting information for the print job. This is described next.

FIG. 24 is a table illustrating a storage state of the temperature distribution profiles in the image forming apparatus 10.

As illustrated in the table, the image forming apparatus 10 stores the temperature distribution profile of the fixing roller 107*a* of an executed print job in the memory 116 in advance while pairing with the content of the print setting information.

In FIG. 24, for example, the profile X10 includes information indicating the temperature distribution of the fixing roller 107*a* after executing a print job of B5 size transfer paper with a portrait orientation and a run length of 1 to 10 sheets. Incidentally, to be exact, the temperature distribution linked with a run length of a single sheet is different from for a run length of 10 sheets and also the temperature distribution depends on the surrounding environment in some degree. However, it is suitable to divide data into groups each having a certain pieces taking into account amount of data and store the average value of each group.

The control device 115 reads out such a temperature distribution profile and calculates a predicted generated power value to control connection and disconnection of the second heat storing plate 112.

Figure 25:
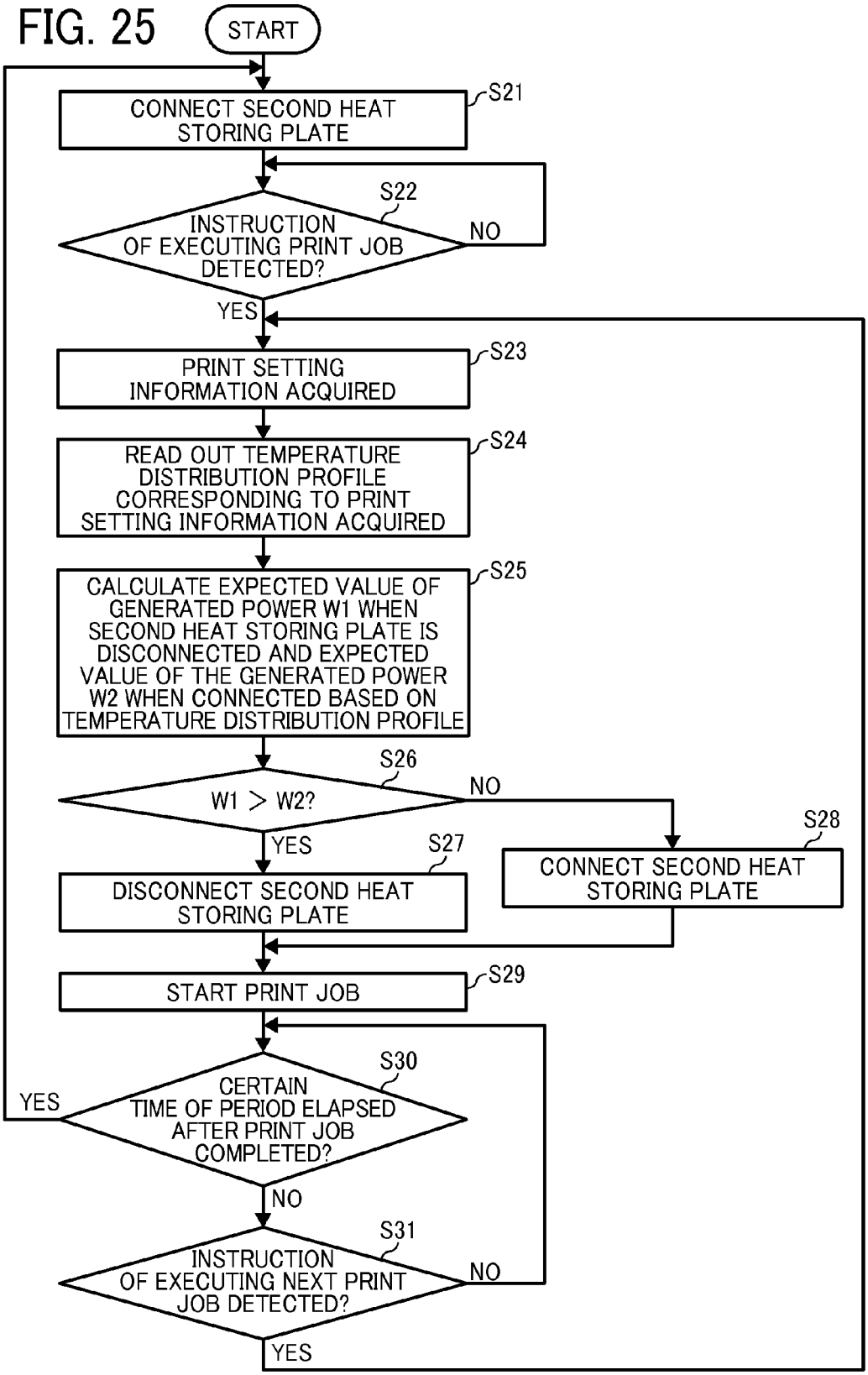
FIG. 25 is a flow chart illustrating control processing about separation and installation of a heat storing plate conducted by the control device of the image forming apparatus illustrated in FIG. 1.

The processing about switch control of connection and disconnection of the second heat storing plate 112 is described next, which is executed by the control device 115 (actually, the processor included therein) of the image forming apparatus 10. FIG. 25 is a flow chart illustrating this processing. This processing relates to embodiment of the image forming method of the present disclosure.

The control device 115 initiates the execution of the processes of the flow chart illustrated in FIG. 25 when the image forming apparatus 10 is started (for example, the time of power-on, resetting).

In the processing illustrated in FIG. 25, the control device 115 controls a switch 112*a* to connect the second heat storing plate 112 with the power generating element 110 (S21). The image forming apparatus 10 normally stands by first after power-on. While it stands by, the obtained generated power is expected to be greater when the second heat storing plate 112 is connected as described above with reference to FIG. 9 to FIG. 11.

Thereafter, the control device 115 stands by until it detects an instruction of executing a print job has been input into the image forming apparatus 10 (S22).

Thereafter, if yes to the step S22, the control device 115 acquires the print setting information based on the content of the detected instruction of executing the print job (S23). The print setting information includes requisites for printing such as the size and orientation of transfer paper, run length, color or monochrome.

This processing is an acquisition procedure and the control device 115 functions as an acquisition device in this processing.

Thereafter, based on the acquired print setting information, the control device 115 reads out the temperature distribution profile that corresponds to the print setting information of the multiple temperature distribution profiles stored in the memory 116 as illustrated in FIG. 18 (S24). Then, based on the temperature distribution profile read out, the control device 115 calculates the expected value of the generated power of the power generating element 110 as the prediction value when the second heat storing plate 112 is disconnected with the power generating element 110 and when the second heat storing plate 112 is connected with the power generating element 110 (S25).

The expected value of the generated power is calculated using the following calculation method.

That is, the expected value W1 of the generated power when the second heat storing plate 112 is disconnected and the expected value W2 of the generated power when the second heat storing plate 112 is connected are represented by the following relations.

$$W1=\alpha\times(T\text{outhot}-T\text{cold})^2$$

$$W2=\alpha\times\{(T\text{outhot}+T\text{inhot})/2-T\text{cold})\}^2\times2$$

In the relations, a represents a proportionality coefficient, Touthot represents the temperature (averaged temperature) transferred from the first heat storing plate 111 to the HOT surface of the power generating element 110, Tinhot represents the temperature (averaged temperature) transferred from the second heat storing plate 112 to the HOT surface of the power generating element 110, and Tcold represents the temperature of the COLD surface of the power generating element 110 (the surface temperature of the COLD surface is considered to be uniform).

Next, the control device 115 determines which of the expected values W1 and W2 is larger (S26).

When W1 is larger than W2 (yes to S26), the control device 115 controls the switch 112*a* to disconnect the second heat storing plate 112 with the power generating element 110 (S27). When W2 is larger than or equal to W1 (no to S26), the control device 115 controls the switch 112*a* to connect the second heat storing plate 112 with the power generating element 110 (S28).

In both cases, thereafter the control device 115 starts the print job according to the instruction detected at Step S22 (S29).

This processing in Step S26 to S28 is a control procedure and the control device 115 functions as a control device in this processing.

Thereafter, the control device 115 stands by until a predetermined time period elapses after the initiated print job is complete (yes to S30) or another instruction of executing the next print job is detected (yes to S31). When the predetermined time period elapses, the control device 115 returns to Step S21 and repeats the processing. When the instruction of the next print job is detected, the control device 115 executes the processing of Step S23 and thereafter.

The temperature distribution profile read out at Step S24 indicates the state of the fixing roller 107*a* after executing the print job according to the print setting information acquired at Step S23.

This control following the temperature distribution profile mainly aims to increase the generated power in a certain period of time from the completion of a print job to when the temperature of the fixing roller 107*a* entirely falls.

After this certain period of time elapses and the next print job is not detected, the temperature of the fixing roller 107*a* gradually falls. Therefore, since it is inferred that a larger generated power is obtained by connecting the second heat storing plate 112 with the power generating element 110, this connection is made at Step S21.

On the other hand, if an instruction of executing the next print job is detected, the control device 115 controls according to the print setting information for use in the print job.

The control device 115 is executing this processing illustrated in FIG. 25 while the power of the image forming apparatus 10 is on.

By the processing illustrated in FIG. 25 described above, the control device 115 suitably controls connection and disconnection between the second heat storing plate 112 and the power generating element 110 according to the content of a print job to be executed which is assigned by the print setting information. For this reason, the power generating element 110 can be operated at a high power generation efficiency even when the temperature of the fixing roller 107*a* is not uniform and its distribution varies depending on the situation.

In addition, since the control device 115 predicts which generated power is higher when connected or disconnected using the temperature distribution profile stored in advance pairing with the print setting information, the control can be conducted with little processing load.

In the present disclosure, specific configurations, of apparatuses including the fixing device, the configuration and arrangement of the heat storing plates, articles of the print setting information to be referred, the specific procedure of the processing, and the thresholds are not limited to those described in the embodiments.

For example, the number of heat storing plates is not limited to two, which is described in the embodiments described above. Also, the size of the heat storing plates is not necessarily the same. There is no need to provide the same number of heat storing plates at both ends. Moreover, if it is possible to switch connection and disconnection between at least one of heat storing plates and a generating element, similar effects can be more or less obtained within the scope of the effect described above. Furthermore, the heat storing plate does not necessarily take a plate-like form.

The effect of making connection and disconnection switchable is to increase the amount of generated power by increasing the temperature difference of the HOT surface and the COLD surface of a power generating element by not storing heat from a low temperature area. Accordingly, it is suitable to make switchable connection and disconnection between a power generating element and a heat storing plate (the second heat storing plate 112 in the embodiments described above) that may have a lower temperature than other portions depending on the situation. With regard to the first heat storing plate 111, since it is provided to the place whose temperature does not easily fall in comparison with other portions, the plate 111 is always connected with the power generating element 110. However, it can be made switchable depending on the cost, etc.

In addition, it is possible to pair the temperature distribution profile of the fixing roller 107*a* with the amount of toner for use in an image fixed on a recording medium (transfer paper) instead of or in addition to the print setting information. This is because if a large amount of toner is used for an image, the fixing roller 107*a* is deprived of heat accordingly so that the temperature thereof is considered to fall. In addition, the toner amount on transfer paper can be deduced by counting the number of dots (black or color) based on the image data of an image formed on the transfer paper.

In this case, as illustrated in FIG. 26, the temperature distribution profile of the fixing roller 107*a* can be stored for each combination of the print setting information and the amount of toner. In addition, in the processing of Step S23 illustrated in FIG. 25, the amount of toner on transfer paper is deduced based on image data of an image formed on the transfer paper for a detected print job and thereafter the temperature distribution profile combined with the print setting information and the amount of toner is read out. Thereafter, according to this temperature distribution profile, each of the expected value W1 of the generated power and the expected value W2 of the generated power is calculated for the next processing.

In such a case, the temperature distribution of the power generating element 110 is appropriately predicted based on the content of image forming and the power generating element 110 can be operated with a high power generation efficiency even when the temperature of the fixing roller 107*a* is not uniform and its distribution varies depending on the situation.

In addition, it is also appropriate to store the temperature distribution profile of the fixing roller 107*a* linked with the print setting information not only at the completion of a print job but also at every certain time elapse interval. This is because if the temperature of the portion corresponding to the first heat storing plate 111 is higher than the other portions and disconnecting the second heat storing plate 112 with the power generating element 110 is preferable, it is inferred that the temperature entirely falls and the temperature difference decreases as the time passes so that connecting both is preferable at some point in time.

In this case, as illustrated in FIG. 27, it is suitable to store the temperature distribution profile of the fixing roller 107*a* for each combination of the print setting information and the elapsed time after the print job is complete. In the processing of Step S24 illustrated in FIG. 25, it is suitable to read out the print setting information and the temperature distribution profile of each elapsed time corresponding to the amount of toner and calculate each of the expected values of the generated power W1 and W2 for each elapsed time. The time when W1 is equal to or shorter than W2 is determined as the certain time of period for use in Step S30. If W1 is equal to or shorter than W2 in the beginning, the certain time of period can be set zero.

In such a case, the power generating element 110 can be operated with a high power generation efficiency considering the change over time of the temperature even when the temperature of the fixing roller 107*a* is not uniform and its distribution varies depending on the situation.

In addition, it is thinkable to provide multiple heaters having different heating ranges as the heater 107*b* to heat the fixing roller 107*a*. For example, it is possible to provide a heater to mainly heat portions in the vicinity of the end and a heater to heat portions around the center.

In this case, the temperature distribution profile of the fixing roller 107*a* is likely to be different depending on which heater is used. Therefore, as illustrated in FIG. 28, it is appropriate to store the temperature distribution profile linked with the combination of the print setting information and the usage status of each heater. The usage status relates to, for example, the output, the rate, the power-on time of each heater.

In the processing illustrated in FIG. 25, it is suitable to acquire the temperature distribution profile corresponding to the usage status (and the print setting information of the print job in execution) of a heater at the completion of the print job or any time during execution to calculate the expected values of the generated power W1 and W2 based on the temperature profile. When W1 is greater than W2, it is suitable to disconnect the second heat storing plate 112 with the power generating element 110.

In addition, in the processing illustrated in FIG. 25, it is also possible to read out not only the temperature distribution profile at the start of a print job but also the temperature distribution profile corresponding to the execution state of the print job up to any given time during the execution of the print job to calculate the expected values of the generated power W1 and W2 and control connection and disconnection of the second heat storing plate 112 depending on the relation of the expected values. For example, when executing a print job with a run length of 100 sheets of transfer paper, the connection and disconnection can be controlled based on the temperature distribution profile corresponding to the case in which the run length is ten sheets of transfer paper at the time of completing printing on the tenth transfer paper and the temperature distribution profile corresponding to the case in which the run length is 20 sheets of transfer paper at the time of completing printing on the 20th transfer paper.

In such a case, when the fixing roller 107*a* is heated by multiple heating devices (heaters), it is possible to operate the power generating element 110 with a high power generation efficiency according to the usage status of the heating devices.

Incidentally, in any case, it is not necessary to refer all of the size and orientation of transfer paper and the run length, or other articles can be referred.

In addition, instead of storing the temperature distribution profile in the image forming apparatus 10, it is possible to have a switching configuration between connection and disconnection in which the temperature to store heat in each condition, W1 or W2, and whether each heat storing plate is connected or disconnected in each condition are stored to be referred in the processing illustrated in FIG. 25.

In addition, it is also appropriate to store a temperature distribution profile or information instead thereof in a storage device provided to a unit outside the image forming apparatus 10 and acquire the information from the unit on a necessity basis.

Furthermore, in the embodiments described above, the COLD surface of the power generating element 110 is kept at 60 degrees C. by using the cooler 113 but the temperature is not limited to 60 degrees C.

Moreover, the present invention can be applied to any image forming apparatus forming images by a system other than electrophotography, which includes a fixing device to fix an image on a recording medium by heating the recording medium.

Furthermore, this can be applied to a heat source for a device other than a fixing device when the temperature rises during image forming if the temperature distribution profile of the heat source is created and connection and disconnection to the heat source can be set.

The description of embodiments of the present disclosure is complete. In the present disclosure, specific configurations of devices, specific configurations of the fixing device and the heat storing member, and specific procedures of execution, etc. are not limited to those described for the embodiments.

Moreover, in embodiments of the program of the present disclosure, the function (mainly function of the acquisition device and the control device) of the control device 115 described above is executed by controlling hardware such as the image forming apparatus 10 by a computer.

This kind of program can be stored in ROM inherently provided in a computer or in a non-volatile storage medium such as flash memory and EEPROM). However, it is also possible to record the program in an arbitrary non-volatile recording medium such as memory card, CD, DVD, and blu-ray disc. The program recorded in such a recording medium is installed into a computer and executed thereby to execute the above-mentioned procedures.

Furthermore, it is also possible to download the program from a networked external device having a recording medium in which the program is recorded or a networked exterior device having a storage device in which the program is stored and install the program into a computer for execution.

In addition, there is no limit to the combination of the configurations of the embodiments and variations described above unless mutual discrepancies occur.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

What is claimed is:

1. An image forming apparatus comprising:

a fixing device configured to fix an image on a recording medium by heating the recording medium;

an electric generating element configured to generate power by converting the heat into power;

multiple heat storing devices configured to store heat generated at the fixing device and configured to supply the heat stored to the electric generating element; and a switch configured to switch connection and disconnection between the electric generating element and at least one of the multiple heat storing devices.

2. The image forming apparatus according to claim 1, further comprising an acquisition device configured to acquire setting information for use in image forming conducted by the image forming apparatus and a control device to control the connection and disconnection by the switch based on the setting information acquired by the acquisition device.

3. The image forming apparatus according to claim 2, further comprising:

a storing device configured to store a temperature distribution of the fixing device linked with the setting information, wherein the control device is configured to acquire the temperature distribution of the fixing device corresponding to the setting information from the storing device and changes the connections and disconnections of the switch based on the temperature distribution to make power generation efficiency of the power generating element higher.

4. The image forming apparatus according to claim 2, further comprising a storing device configured to store temperature distribution linking information in which the setting information is linked with a temperature distribution of the fixing device obtained after image forming is conducted, wherein, based on the temperature distribution linking information and the setting information acquired by the acquisition device, the control device is configured to calculate an expected temperature distribution of the fixing device after image forming is conducted according to the setting information acquired by the acquisition device and configured to change the connections and disconnections of the switch based on the expected temperature distribution to make power generation efficiency of the power generating element higher.

5. The image forming apparatus according to claim 2, wherein the setting information includes information of the recording medium for use in the image forming.

6. The image forming apparatus according to claim 2, further comprising:

a storing device configured to store temperature distribution linking information in which a combination of the setting information and an amount of toner for use in an image fixed on the recording medium is linked with a temperature distribution of the fixing device obtained after image forming is conducted, wherein, based on the temperature distribution linking information, the setting information acquired by the acquisition device, and image data of the image to be formed on the recording medium, the control device is configured to calculate an expected temperature distribution of the fixing device after image forming is conducted according to the setting information acquired by the acquisition device and configured to change the connections and disconnections of the switch based on the expected temperature distribution to make power generation efficiency of the power generating element higher.

7. The image forming apparatus according to claim 4, wherein, based on the setting information acquired by the acquisition device and the temperature distribution linking information, the control device is configured to calculate an expected change of the temperature distribution of the fixing device over time after image forming is conducted according to the setting information acquired by the acquisition device and configured to change the connections and disconnections of the switch based on the expected change of the temperature distribution to make power generation efficiency of the power generating element higher.

8. The image forming apparatus according to claim 2, wherein the fixing device includes multiple heaters having different heating ranges to heat the fixing device, wherein the image forming apparatus further includes a storing device configured to store temperature distribution linking information in which a combination of the setting information and usage status of the multiple heaters to heat the fixing device is linked with a temperature distribution of the fixing device obtained after image forming is conducted, and wherein, based on the temperature distribution linking information, the setting information acquired by the acquisition device, and information on which of the multiple heaters is used when image forming is conducted according to the setting information, the control device is configured to calculate an expected temperature distribution of the fixing device after image forming is conducted according to the setting information acquired by the acquisition device and configured to change the connections and disconnections of the switch based on the expected temperature distribution to make power generation efficiency of the power generating element higher.

9. An image forming method, comprising:

acquiring setting information indicating a content of image forming conducted by an image forming apparatus including a fixing device to heat a recording medium to fix an image thereon, an electric generating element to generate power by converting the heat into power, multiple heat storing devices to store heat generated at the fixing device and supply the heat stored to the electric generating element, and a switch to switch connection and disconnection between the electric generating element and at least one of the multiple heat storing devices; and controlling switching the connection and the disconnection by a switch based on the setting information acquired in the step of acquiring setting information.

10. A non-transitory recording medium which, when executed by one or more processors, perform an image forming method, comprising the steps of:

acquiring setting information indicating a content of image forming conducted by an image forming apparatus including a fixing device to heat a recording medium to fix an image thereon, an electric generating element to generate power by converting the heat into power, multiple heat storing devices to store heat generated at the fixing device and supply the heat stored to the electric generating element, and a switch to switch connection and disconnection between the electric generating element and at least one of the multiple heat storing devices; and controlling switching the connection and the disconnection by a switch based on the setting information acquired by the step of acquiring setting information.

11. The image forming apparatus according to claim 1, wherein the multiple heat storing devices are provided along a longitudinal direction of the fixing device and include a first heat storing device and a second heat storing device provided inside of the fixing device in the longitudinal direction, and wherein the switch switches connection and disconnection between the electric generating element and at least the second heat storing device.

* * * * *